US005443330A

United States Patent [19]

Copple

[11] Patent Number: 5,443,330

[45] Date of Patent: * Aug. 22, 1995

[54] DEEP WATER PLATFORM WITH BUOYANT FLEXIBLE PILES

[76] Inventor: Robert W. Copple, 5 Glen Dr., Mill Valley, Calif. 94941

[ * ] Notice: The portion of the term of this patent subsequent to Jun. 2, 2009 has been disclaimed.

[21] Appl. No.: 13,008

[22] Filed: Feb. 3, 1993

Related U.S. Application Data

[63] Continuation-in-part of Ser. No. 676,850, Mar. 28, 1991, Pat. No. 5,118,221.

[51] Int. Cl.[6] ..... E02B 17/00; E21B 7/12

[52] U.S. Cl. ..... 405/224.2; 405/195.1; 405/224; 405/223.1; 166/367

[58] Field of Search ..... 405/195.1, 196, 203, 405/223.1, 224, 224.2, 224.3, 224.4, 228; 166/350, 359, 367; 175/7; 114/265; 138/89

[56] References Cited

U.S. PATENT DOCUMENTS

| | | | |
|---|---|---|---|
| 1,365,197 | 1/1921 | Scott | 405/224 |
| 2,351,449 | 6/1944 | Noble | 405/224 |
| 2,901,890 | 9/1959 | Hutchison | 405/224 |
| 2,986,889 | 6/1961 | Ludwig | 405/224 |
| 3,031,997 | 5/1962 | Nesbitt . | |
| 3,154,039 | 10/1964 | Knapp . | |
| 3,395,755 | 8/1968 | Manning | 166/359 X |
| 3,643,446 | 2/1972 | Mott . | |
| 3,646,598 | 2/1972 | Chelminski | 405/228 |
| 3,710,580 | 1/1973 | Mott . | |
| 3,720,066 | 3/1973 | Vilain . | |
| 3,922,868 | 12/1975 | McDonald . | |
| 4,040,264 | 8/1977 | Neilon | 405/224.2 |
| 4,060,995 | 12/1977 | Lacroix et al. . | |
| 4,087,984 | 5/1978 | Mo | 405/224 X |
| 4,117,690 | 10/1978 | Besse | 405/227 |
| 4,142,819 | 3/1979 | Challine et al. | 405/196 |
| 4,185,694 | 1/1980 | Horton | 405/223.1 X |
| 4,266,499 | 5/1981 | Tam | 405/224 X |
| 4,365,912 | 12/1982 | Burns | 405/224 X |
| 4,373,835 | 2/1983 | Haney | 405/195.1 |
| 4,468,157 | 8/1984 | Horton | 405/224 |
| 4,621,949 | 11/1986 | Marshall et al. | 405/202 |
| 4,630,970 | 12/1986 | Gunderson et al. | 405/224 |
| 4,648,747 | 3/1987 | Watkins | 405/224.2 |
| 4,797,033 | 1/1989 | Pollack | 405/224 X |
| 4,813,815 | 3/1989 | McGehee | 405/224 X |
| 4,821,804 | 4/1989 | Pierce | 166/367 |
| 4,861,196 | 8/1989 | Folse | 405/224 |
| 4,923,337 | 5/1990 | Huard | 405/224 |
| 5,118,221 | 6/1992 | Copple | 405/224.2 |

FOREIGN PATENT DOCUMENTS

| | | | |
|---|---|---|---|
| 1302162 | 7/1962 | France | 405/224 |
| 2174133A | 10/1986 | United Kingdom . | |

OTHER PUBLICATIONS

"Exploring the Ocean's Frontiers", Time Magazine, Dec. 17, 1990, p. 98.

Engineering News Record, Aug. 27, 1987, "The Newcomer Tackles the Moose".

Graff, W. J., "Introduction to Offshore Structures", Gulf Publishing Co., 1981.

*Primary Examiner*—Randolph A. Reese
*Assistant Examiner*—John A. Ricci
*Attorney, Agent, or Firm*—Coudert Brothers

[57] ABSTRACT

A deep water platform, suitable for use as a hydrocarbon exploration or production facility in very deep offshore waters, and a method of constructing the same are shown. The platform is positioned on top of flexible, buoyant piles made of large diameter, high strength steel tubing. A watertight bulkhead is located within the pile and the portion of the pile below is filled with seawater, while the portion above the bulkhead is substantially empty and in communication with the atmosphere. The bulkhead is positioned to cause the pile to have a predetermined net buoyancy so that the portion below the bulkhead, which is anchored to the seabed, is in tension. Bending members (trusses) are joined to the top of the pile and are connected to a plurality of neutral buoyancy tendons anchored to the sea floor. The tendons may be driven into the sea floor using a pile driver located within the tendons.

9 Claims, 16 Drawing Sheets part A part A part B part B

DEEP WATER PLATFORM WITH BUOYANT FLEXIBLE PILES

RELATED APPLICATIONS

This application is a continuation-in-part of application Ser. No. PCT/US92/02458, filed Mar. 25, 1992 under the Patent Cooperation Treaty, which, in turn, is a continuation-in-part of U.S. application Ser. No. 07/676,850, filed Mar. 28, 1991, now issued as U.S. Pat. No. 5,118,221.

FIELD OF THE INVENTION

The present invention pertains to support structures for deep water platforms, especially those of the type which are used for crude oil exploration and production.

BACKGROUND OF THE INVENTION

There exists an ever increasing demand for oil and gas production from offshore deep water sites. Traditional designs and construction techniques for offshore platforms, most of which have heretofore been constructed in relatively shallow waters, are not readily adaptable for use at very deep locations, for example sites where the water depth exceeds 1000 feet. While several deep water platform designs have been proposed, known designs are either very complicated, expensive, and/or difficult to construct.

Environmental forces, primarily winds, waves and currents can, at times, be very severe at an offshore location, particularly a deep water location which is unlikely to be near any sheltering land mass. Thus, any design for an offshore platform must be able to tolerate the full range of conditions likely to be encountered at the site.

Construction techniques useful at deep water sites are limited. Difficulty arises in bringing long prefabricated structures to a site, providing anchors at a desired seabed location, and anchoring the structures at great depth.

Therefore, an object of the present invention is to provide an offshore platform which is suitable for use at great depths.

Another object of the present invention is to provide an offshore deep water platform which is simple in design, and which is relatively easy and inexpensive to construct.

SUMMARY OF THE INVENTION

The present invention makes use of flexible buoyant piles, rigidly anchored to the seabed, to support an offshore platform or other facility. The piles comprise large diameter tubes, partially filled with seawater in a lower portion and substantially empty in an upper portion, to provide a predetermined buoyancy. Stiff trusses or girders rigidly connecting the piles at or near their upper ends helps prevent lateral and rotational movement of the structure in severe environmental conditions.

The piles of the present invention utilize the buoyancy of large diameter pipes which may be made of high strength steel. Although the diameter of the pipes is relatively large, the diameter is very small in comparison to the length of pipe needed to extend from the water surface to the seabed at a deep water site. Thus, while such a pipe will be comparatively stiff in short lengths, it will be quite flexible over the lengths of interest in deep water applications. The overall amount of flexibility is a function of the length of the pipe, the pipe diameter, the thickness of the walls of the pipe, and the material from which the pipe is fabricated. The diameter of the piles contemplated by this invention may be large enough to accommodate the conduits, risers, and other equipment typically associated with offshore oil platforms. This allows many of the functions performed at the offshore site, e.g., drilling and production, to be conducted from within the pile. Moreover, the piles may be of sufficient diameter to allow human access throughout the empty portion thereof.

A pile constructed in accordance with the present invention is made buoyant by at least partially emptying its interior volume, so that a large volume of water is displaced. A watertight bulkhead is located within the pile, and the portion of the pile below the bulkhead is filled with seawater to provide a predetermined amount of overall buoyancy to the pile. The optimal buoyancy will depend on a variety of factors which are discussed below. The pipe is rigidly anchored to the seabed. In one embodiment anchoring is provided by driving the pipe into the subsurface using a pile driver. In this embodiment, additional anchoring may be provided, for example, by driving smaller diameter pipes, located within the hollow pile, further into the seabed and then grouting them to sleeves connected to the pile. In another embodiment, anchoring may be provided by a stiff bending member, such as a truss, or similar arrangement, located on and attached to the sea floor. The truss may include skirt pile sleeves, thus permitting the use of skirt piles to anchor the structure to the sea floor. The buoyant force, in combination with the anchoring, acts to keep the pile stabilized.

A plurality of piles may be driven at a desired site and a platform structure mounted thereon. The platform may be then outfitted for use as an oil drilling or production facility. By providing rigid bending members, such as trusses or girders, between the pile tops it is possible to further stabilize the structure and to minimize overall rotational displacement of the platform when it is being acted upon by severe environmental conditions. Further enhancements to the basic structure are set forth in the following detailed description.

It will be seen that a platform constructed in accordance with the foregoing is simple in design, inexpensive, easy to construct and well-suited to deep water, offshore applications.

In another embodiment, a single buoyant pile is used to support a platform connected to a plurality of bending members. A tendon, anchored to the sea floor, is connected to each of the bending members to stabilize the structure.

The above features and advantages of the present invention, together with the superior aspects thereof, will be appreciated by those skilled in the art upon reading the following detailed description in conjunction with the drawings.

BRIEF DESCRIPTION OF THE DRAWINGS

FIG. 8A is the upper portion of the oil platform and FIG. 8B is the lower portion of the platform.

FIG. 9A is the upper portion of the oil platform and FIG. 9B is the lower portion of the platform.

DETAILED DESCRIPTION OF THE PREFERRED EMBODIMENTS

Figure 1:
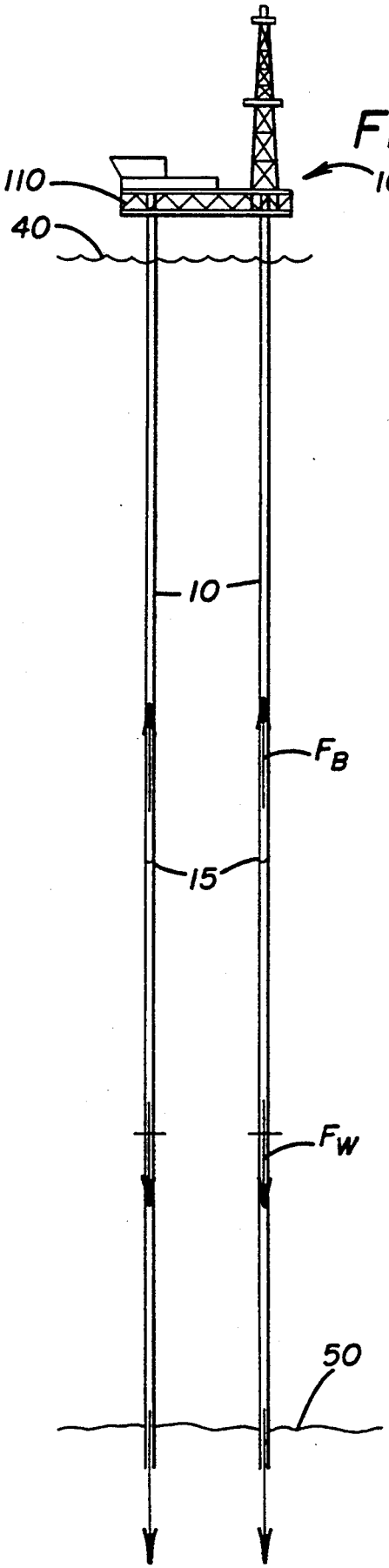
FIG. 1 is an elevation of a deep water oil platform in accordance with the present invention.

In the following detailed description, like pans are marked throughout the specification and drawings with the same reference numerals. The figures are not necessarily drown to scale, and certain features of the invention and distances may be shown exaggerated in scale in the interest of clarity. Certain features not necessary to an understanding of the invention but which are normally included in offshore oil platforms have been omitted. The omitted features are considered conventional and are well-known to those skilled in the art.

Figure 2:
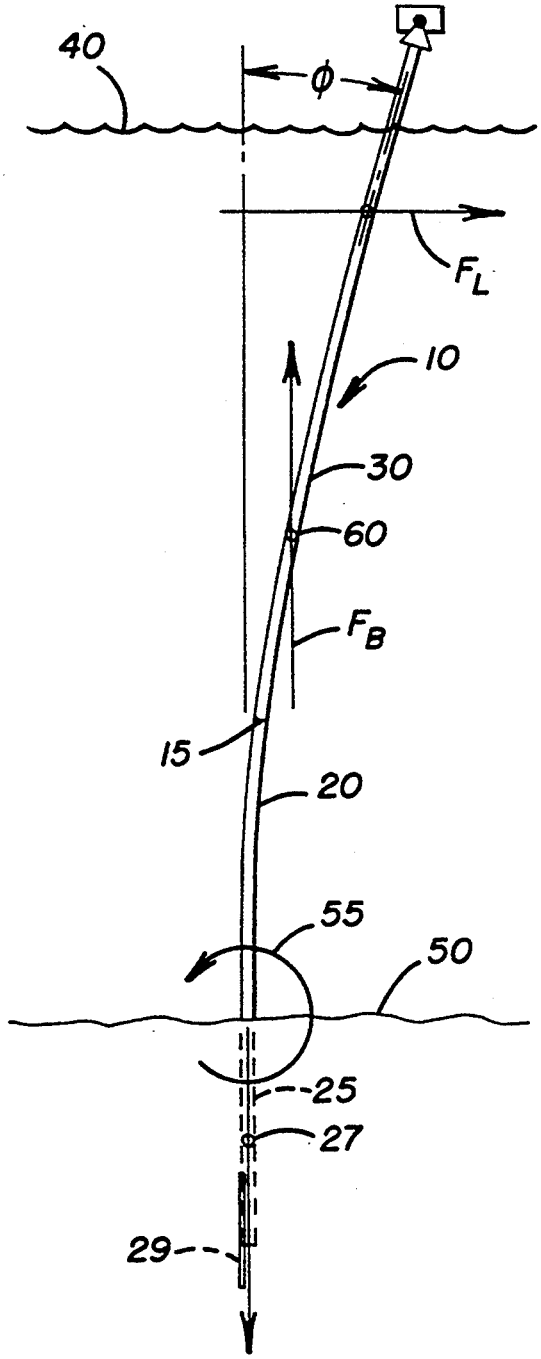
FIG. 2 is an elevation of a flexible pile, constructed in accordance with the present invention, being displaced due to a lateral force thereon.

A pile 10, constructed in accordance with the present invention, is shown in FIG. 2. Pile 10 is constructed of a plurality of hollow pipe segments which may, preferably, be made of high strength steel. In the preferred embodiment the diameter of the pipe is between th to 1/200th of the water depth at the site. The manner of constructing the pile is described in detail below. A watertight bulkhead 15 is located within pile 10 and separates a lower portion 20 of pile 10 from an upper portion 30. Lower portion 20 is filled with seawater and may be in communication with the water outside the pile, while upper portion 30 is left empty and is in communication with the atmosphere. The substantial empty volume above bulkhead 15 can also be used for product storage, for example, to temporarily store crude oil pumped from beneath the seabed until it can be off loaded onto a tanker. The lower portion 20 of the pile 10 can also be used for product storage so long as precautions are taken to prevent release of product to the environment.

Given the arrangement described, a large volume of seawater is displaced and thereby causes pile 10 to be buoyant. By selecting the placement of bulkhead 15, the overall buoyancy of pile 10 may be predetermined. Pile 10 is rigidly anchored to the seabed 50, preferably by being driven into seabed 50 using pile driving means, or by attachment to a truss with is anchored to the sea floor, as by skirt piles. When the pile is driven, a portion 25 of pile 10 is below the seabed. The topmost portion of pile 10 protrudes above sea level 40.

In FIG. 2 a net lateral force $F_L$ due to wind, waves, currents and the like is shown acting on pile 10. As noted above, the pile is relatively flexible due to its great length, and, therefore, the top of pile 10 is displaced laterally by force $F_L$. This lateral movement is resisted by the bending of pile 10, which is vertically fixed at the seabed 50, creating bending moment 55 and by buoyant force $F_B$ acting at the center of buoyancy 60. The greater the lateral movement of pile 10, sometimes called the horizontal excursion of the pile, the greater the righting moment is; where the righting moment is proportional to the bending moments 55 and 95 plus the buoyant force times the horizontal distance between the base of pile 10 and the center of buoyancy 60. Stated equivalently, this distance is the horizontal displacement of the center of buoyancy 60 from its location when pile 10 is in a full upright position.

Figure 9:
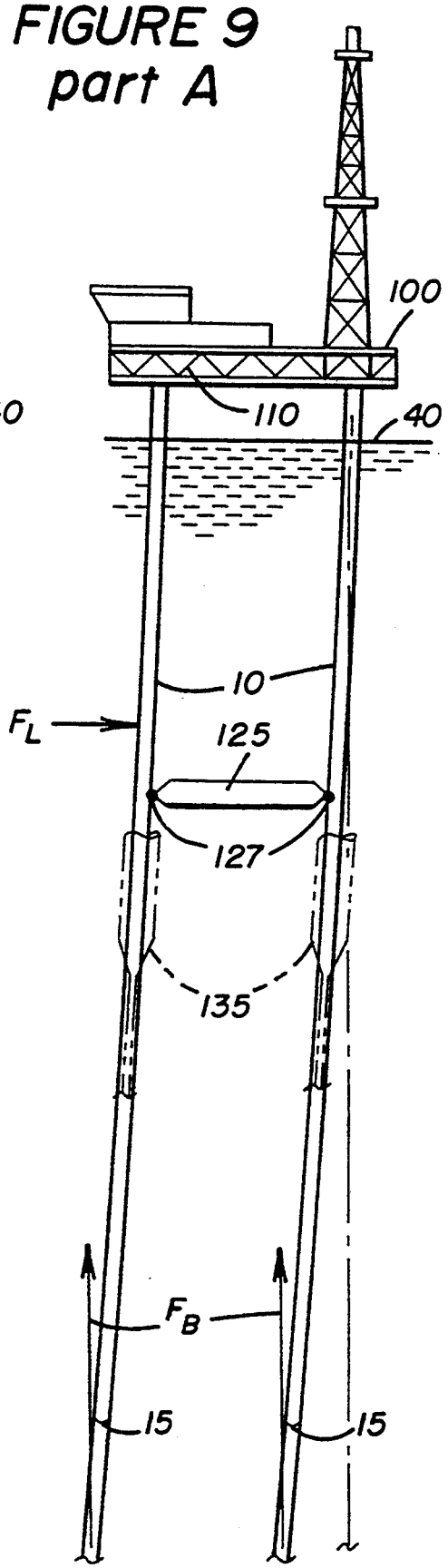
FIG. 9A and 9B are an elevation of an oil platform, constructed in accordance with another embodiment of the present invention, being displaced due to a lateral force thereon.
Figure 8:
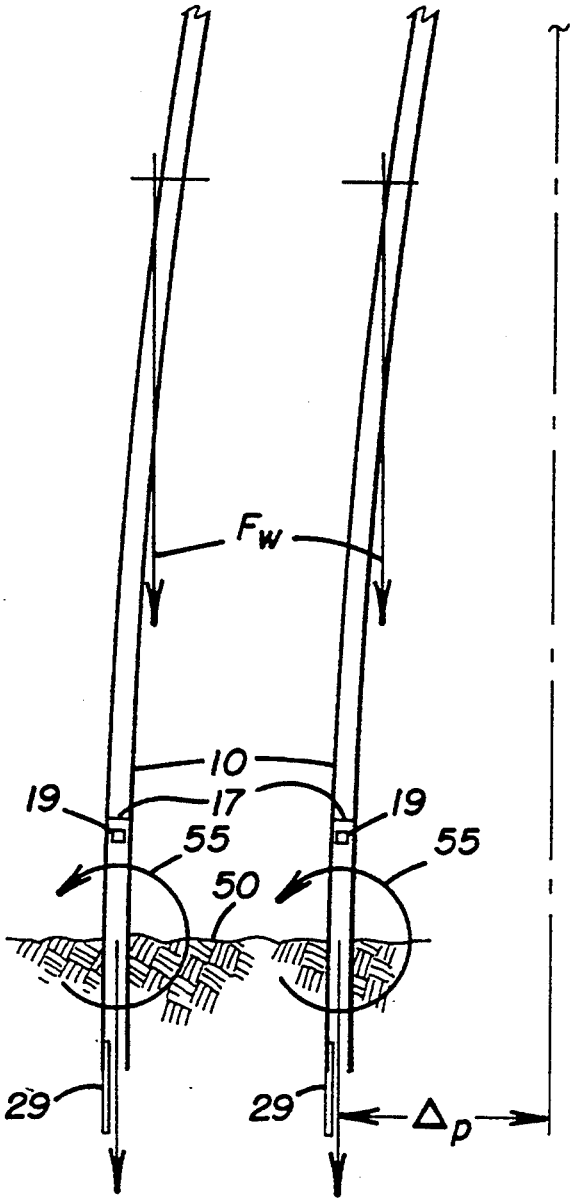
Figure 9:
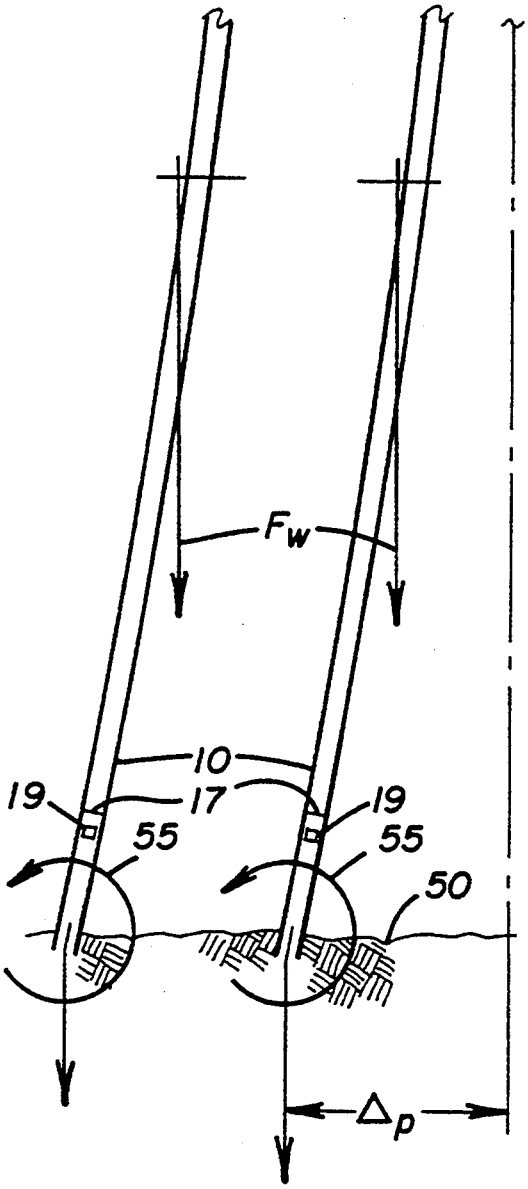

It should also be recognized that, due to the conditions at many sites the seabed will not be entirely rigid but will yield in response to the very high localized forces in the vicinity of the pile bottom. This is shown in FIG. 9, wherein the pile bottom at seabed 50 is no longer fully vertical, due to a large lateral force $F_L$. A certain amount of flexibility in the seabed is beneficial insofar as it relieves and distributes the force, which would otherwise be very large, at that location. Nonetheless, it is apparent that a seabed which is too yielding will not provide very good anchorage. If pile 10 is driven deep enough into the seabed, there will be a point of fixity 27 (shown in FIG. 2) below which the portion 25 of pile 10 will remain vertical under all expected values of $F_L$.

Likewise, there may be very hard rock at or just below the seabed making it impossible to obtain adequate anchorage by driving the pile 10 or by driving skirt piles. In such a situation, other means of anchoring the pile, such as attachment to the rock, will be required. An alternate anchoring technique may not provide the same overall rigidity at the bottom of the pile, thereby reducing the bending moment at the bottom and increasing the lateral excursion when pile 10 is subject to lateral forces.

One preferred embodiment of the present invention, comprising a platform 100 and a plurality of buoyant piles 10, is shown in FIG. 1. Situated on the platform are the facilities necessary to perform the functions desired to be performed at the site. Such an embodiment is useful at deep water sites where the seabed 50 may be as much as 10,000 ft below sea level. For clarity, only two piles are shown in FIG. 1; however, in the preferred embodiments three or four piles are used.

Figure 8:
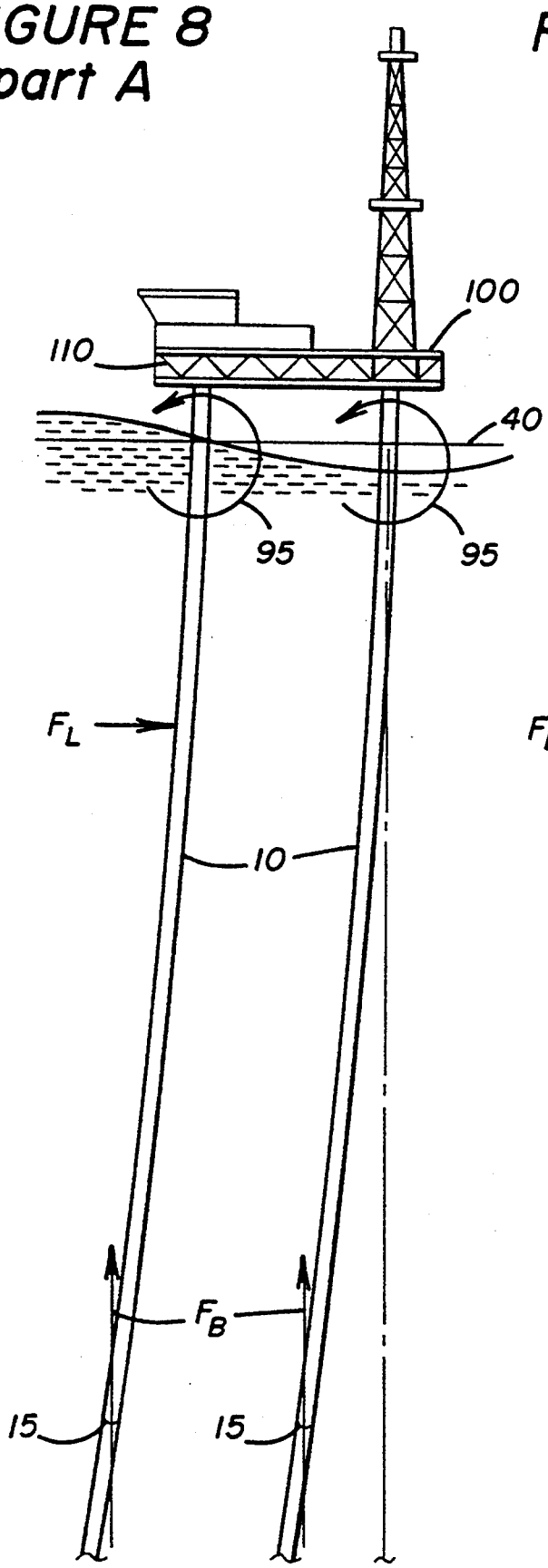
FIG. 8A and 8B are an elevation of an oil platform, constructed in accordance with an embodiment of the present invention, being displaced due to a lateral force thereon.

The tops of piles 10 are interconnected by a network of rigid bending members such as very stiff and strong girders or trusses 110. The stiffness of network 110 should be sufficient to prevent noticeable rotation of the platform and the pile tops as the piles flex in response to lateral forces, i.e., a minimal departure of the platform surface from the horizontal under such conditions. This result is achieved where the rigid network 110 is attached to each pile 10 at multiple points along its topmost portion. Consider, for example, two points near the top of each of two parallel piles, such that the resulting four points form a rectangle when the piles are vertical. When a lateral force is applied to the piles, the shape formed by these four points will be distorted into a parallelogram in the absence of any interconnection between the points. If, however, the points are rigidly interconnected to maintain a rectangular shape, the top of the rectangle will remain horizontal at all times. As a consequence, when a lateral force $F_L$ is applied to the piles they adopt a double curved shape as shown in FIG. 8. It follows that in order to maintain its rectangular shape when a lateral force is applied, the rigid network will generate a righting moment which resists lateral displacement of the piles. In other words, the overall flexibility and lateral excursion of the system will decrease.

An example of a buoyant pile platform will now be described. An open ocean site is selected where there is stiff clay for several hundred feet below seabed 50. The seabed is 2000 feet below sea level. The platform 100 is to be positioned 100 ft above sea level 40 to provide ample room for the largest expected waves and to accommodate the downward movement of the piles as they are flexed in response to the largest expected lateral forces. It should be understood that the greatest lateral force will arise when the maximum wind and waves forces are in the same direction as the current at the site.

Twenty-three segments of prefabricated pipe 100 ft long and 20 ft in diameter, with a nominal wall thickness of $1\frac{3}{8}''$, are joined at the site in a manner described below to form three piles 2300 ft in length. These piles are then driven 200 ft into the seabed using pile driving means. A permanent, watertight bulkhead 15 is located 1000 ft above the seabed, i.e., 1000 ft below sea level. Each pipe segment weighs 200 tons with its internal conduits, diaphragms, bulkheads, sleeves, etc., and displaces 1005 tons of seawater when the interior volume of the pipe segment is empty. When the interior volume of the pipe is filled with seawater the pipe displaces 26 tons of seawater. Therefore, the net weight of an immersed open ended segment is 174 tons, and the net buoyancy of an air filled pipe segment is 805 tons.

Needless to say, a thorough stress analysis must be conducted prior to developing the specific design for any given site. The methods of performing such analyses are generally known to those skilled in the art. It is necessary to take into account the wind, wave and current forces present at the site under most extreme environmental conditions likely to be encountered.

Winds and waves are essentially surface phenomena. Likewise, currents tend to be greatest near the surface of the water and reduce to negligible amounts within several hundred feet. Thus, the net lateral force $F_L$ will act on pile 10 at a point near sea level 40, as shown in FIGS. 2, 8 and 9.

Two other significant forces on the pile in deep water are the hydrostatic pressure, which is a function of depth, and the buoyant force $F_B$ (which equals the weight of the displaced water) acting at the center of buoyancy 60, i.e., the center of gravity of the displaced water. At 1000 ft below sea level the hydrostatic pressure equals 64,000 pounds per square foot for salt water. While in the preferred embodiment this will not affect the water-filled lower portion 20 of pile 10 below bulkhead 15 which is in communication with the surrounding water and therefore subject to equal pressure in all directions, it causes an enormous force on the empty pile above bulkhead 15, i.e., upper portion 30, placing it in radial and circumferential compression. It should be noted that the cylindrical shape of the piles of the present invention is well suited to withstand such pressure.

The weight of the pile and the weight of the platform and related facilities exerts a downward compressive force $F_w$ along the length of the pile. The magnitude of this force varies over the length of pile 10 and is a function of the pile position, with the lowermost portion of the pile experiencing the greatest force, since the weight of the entire column acts on the lower portion. In the preferred embodiment of the present invention this is offset by the larger overall buoyant force $F_B$ so that the entire length of the pile below bulkhead 15 is in tension. The upper portion 30 of pile 10 above bulkhead 15 is in compression as described above.

A sample stress calculation will now be given. The following assumptions, some of which differ from the above example and some of which are for the purpose of simplifying the discussion, have been made: (1) A platform is mounted on three 20 ft diameter, 1" thick piles; (2) the distance between sea level and the seabed is 2000 ft beneath each of the piles, so that the weight of the portion of each pile between sea level and the seabed, including all internal structures such as conduits, diaphragms, etc. is 8000 kips, i.e., 4 kips/ft; (3) the platform deck is 100 ft above sea level; (4) the rigid network extends from the platform deck 30 ft down, creating an upper point of fixity 70 ft above sea level; (5) due to the seabed soil conditions the lower point of fixity is 70 ft below the seabed; (6) the permanent watertight bulkhead is 1200 ft below sea level; (7) the weight of the platform, including the rigid network, all the facilities mounted on the platform, and the portion of the pile above sea level is 21,000 kips, and this weight is evenly distributed among the three piles, i.e., the weight on each pile is 7,000 kips; (8) the worst case environmental conditions are 60 ft waves, 125 mph winds, and a 2.5 mph current at sea level, diminishing to 0 mph at 600 ft below sea level, and that all these forces are equal on all three piles and act in the same direction, resulting in a net lateral force of 450 kips per pile. (One kip=1,000 lbs=$\frac{1}{2}$ ton.)

From the above there will be a buoyant force of approximately 24,000 kips acting on a center of buoyancy 60 (i.e., the center of gravity of the displaced water), approximately 1400 ft above seabed 50. Since piles 10 are fixed in the vertical about a lower and upper point of fixity, equal upper and lower bending moments are generated in response to the lateral force. These bending moments have been calculated to be approximately 146,000 kips-ft.

The above forces will be applied to a typical pile in the following manner. The primary forces acting to cause an overturning moment about the lower point of fixity are the lateral, i.e., environmental forces, which are applied to the pile relatively close to sea level. The net lateral force will cause the tops of the piles to move horizontally, thereby causing a horizontal excursion of the center of buoyancy, the center of gravity of the pile and the center of gravity of the platform. The overturning moment will equal the sum of the separate moments caused by the net lateral force, and by the displaced weights. The moments created by each weight will equal the magnitude of the weight times the distance of the horizontal excursion of the weight measured from the point of fixity. It is self evident that the horizontal excursion of the center of gravity will be smaller than the total horizontal excursion $\Delta p$ of the platform. It is also apparent that the greater the horizontal excursion caused by the net lateral force, the greater the overturning moment caused by the shifting of the weight, i.e., the more the pile moves, the greater the overturning moment.

Resisting the overturning moment is the righting moment. The righting moment, likewise, has three components. The first component is caused by the buoyant force acting at the center of buoyancy. Again, this moment is proportional to the horizontal displacement of the center of buoyancy. It will be noted that since the center of buoyancy will be above the center of gravity of the pile, the moment arm (i.e., the horizontal displacement) associated with it will be greater. The other components of the righting moment are the bending moments at the top and bottom of the pile. So long as the piles are able to generate a righting moment which equals the largest expected overturning moment they will achieve equilibrium for any value of lateral force. In the foregoing example, equilibrium was established when these moments were calculated to be approximately 1,900,000 kips-ft.

Other calculations show: (1) the lateral excursion of the platform will be less than 90 ft (shown as $\Delta p$ in FIGS. 8 and 9), with the center of buoyancy being displaced approximately 68 ft and the platform deck being lowered by just a few feet (lowering of the platform must be taken into account so that sufficient freeboard exists under the high wave conditions likely to be associated with the extreme conditions); (2) the tension at the anchorage will be approximately 8700 kips and the tension stress at the anchorage 7.3 kips/in$^2$; (3) the compression stress at the top of the pile will be approximately 9.3 kips/in$^2$; (4) the compression stress just above the bulkhead will be approximately 14.6 kips/in$^2$; (5) the tension stress just below the bulkhead will be approximately 17.4 kips/in$^2$; (6) the combined bending and compression stresses at the top of the pile will be as high as approximately 48 kips/in$^2$; and, (7) the combined bending and tension stress at the bottom of the pile will be as high as approximately 46 kips/in$^2$. All the foregoing calculated stresses are reasonable for high strength steel.

The foregoing calculations are somewhat complex to perform although well within the ability of one skilled in the art of structural engineering. In view of the many factors involved it is not possible to provide a formula for determining the optimal location of the watertight bulkhead. In the preferred embodiment, bulkhead 15 must be located far enough below sea level to cause the pile to be buoyant, i.e., the weight of the displaced water should exceed the weight of the loaded pile. Important factors that enter into a determination of the optimal location include the number of piles, the weight of the load to be supported, the depth of the water at the site, the maximum environmental stresses that may be encountered at the site, the choice of pile material, including the diameter, thickness, density, moment of inertia and other inherent material properties, the nature of the seabed, etc.

Generally speaking, lowering the bulkhead will cause more water to be displaced thereby increasing the buoyancy of the pile. It follows that the tension in the pile at the seabed will also increase requiring that the anchorage be quite strong. While lowering the bulkhead will lower the center of buoyancy, (having only a small effect on the horizontal location of the center of gravity) the extra buoyancy will generate an increased overall righting moment, increasing the overall stability of the pile, provided that the anchorage is strong. Finally, the lower the bulkhead, the greater the radial and circumferential compressive forces on the pile immediately above the bulkhead, since this point will be a greater distance below sea level.

Overall, increasing the buoyancy of the pile enhances its ability to withstand extreme environmental forces. However, there will be a point when increased buoyancy will create too much tension in the pile and cannot be tolerated. There may be circumstances when an anchorage of sufficient strength cannot be provided. Even when a solid anchorage is possible the allowable tension is limited by the tensile strength of the pile material. When a good anchorage cannot be provided, and environmental forces are not too severe, it may be desired to design the pile to have neutral, or even slightly negative buoyancy. Negative buoyancy will, of course, assist in anchoring the pile. Even when there is slightly negative buoyancy, the righting moment generated by the horizontal displacement of the center of buoyancy can exceed the overturning moment generated by the horizontal displacement of the weight due to the fact that the buoyant force is acting on a longer moment arm.

By varying the diameter or the wall thickness of the buoyant pile one can obtain different effects. For example, if the diameter of the upper part of pile 10 is increased, the buoyant force $F_B$ is increased, with the distance from the seabed 50 to the center of buoyancy 60 increased, and the horizontal distance between the anchorage and the center of buoyancy is increased for a given $F_L$. Thus, the righting moment will increase and the lateral movement of the pile will be decreased for a given $F_L$. The smaller diameter lower portion will have more flexibility resulting in less stress for a given lateral excursion. Such an arrangement is shown symbolically at 135 in FIG. 9.

Likewise, by increasing the wall thickness of the pile in the vicinity of the seabed it is possible to compensate for the locally high cyclical bending stress.

Underwater horizontal struts 125 (one such strut is shown in FIG. 9) can be fixed to the piles. Such struts can add buoyancy by, for example, making them of air-filled sealed pipe. Such added buoyancy may be beneficial if the struts are in the upper portion of the pile. Preferably, such struts should be located below the depth of the wave and current forces so as to minimize any added lateral loading. Struts 125 can be joined to piles 10 by pin connections 127. Struts 125 will also assist in maintaining the desired distance between very long piles.

A construction procedure, useful in building the piles of the present invention, is as follows. The pile segments are brought to the site by a barge. In one of the above examples 100 ft segments were described; however, considering the present size and capacity of marine cranes and barges, segments up to 300 ft in length could also be used. Piping, diaphragms, stiffeners and conduits used permanently are preinstalled in each pipe segment. Preselected segments also contain the permanent watertight bulkhead 15 and a construction bulkhead 17 (shown in FIGS. 8 and 9).

The first pile segment is then placed and held in the water so that it sits vertically in the water with only its topmost portion protruding above the surface. A welding platform and gantry may be located at one end of the barge so as to surround the protruding portion of the pipe segment. The second segment is lifted into registry with the first segment by a marine crane and welded to the top of the first segment. This process is continued with the remaining pile segments, with the construction bulkhead 17 being used to create buoyancy to support the pile under construction as follows.

In most situations one of the first three pile segments will contain the construction bulkhead 17. The pile segment which contains the construction bulkhead will be determined by the length of the pile segments and the depth that the pile is to be driven into the seabed. The pile is designed so that construction bulkhead 17 is positioned above the seabed after the pile is fully driven, as shown in FIGS. 8 and 9, since it would be impractical to drive bulkhead 17 into the seabed. Thus, when using 100 ft pile segments and assuming that the pile is to be driven 200 ft into the seabed, the construction bulkhead should be located in the third pile segment. On the other hand when using 200 ft pile segments, and assuming that the pile is to be driven 150 ft into the seabed, the construction bulkhead should be in the first pile segment.

Once the pile segment containing construction bulkhead 17 is incorporated into the pile the overall buoyancy of the resulting pile portion is adjustable by partially flooding the volume above the construction bulkhead so that the topmost portion of the pile under construction may be made to protrude above the surface of the water by virtue of its own buoyancy. The process of adding additional segments and adjusting the buoyancy is then repeated with the remaining segments until pile 10 reaches the seabed.

Next, the buoyancy of the pile is reduced by filling a portion of the pile volume above the permanent bulkhead with water so that the bottom tip of the pile is driven into the seabed by its own weight. The buoyancy should not be reduced to the point that the lower part of the pile is overloaded in compression. Moreover, a certain amount of buoyancy is necessary to maintain the pile in a vertical orientation, in addition to ensuring that the lower part is not overloaded.

A pile driver then drives pile 10 deep into the seabed 50. If the depth that the pile is to be driven exceeds the length of a pile segment it may be necessary to add one or more additional segments of pipe during the pile driving process. However, this is not preferred due to problems which may arise if pile driving is interrupted.

There must be openings 19 (shown in FIGS. 8 and 9) in the pile above the seabed to allow water to escape during pile driving. Preferably, these openings are several feet below bulkhead 17, and there is an air pocket between the openings and the bulkhead. The openings are necessary because the trapped water would otherwise cause the pile to act as a solid cylinder, making the pile driving operation much more difficult. The air pocket serves as a shock absorber to reduce the impact forces that could otherwise rupture the construction bulkhead. During the pile driving process the buoyancy of the pile is kept as low as possible but must not be too low for the reasons described above. As the pile is driven it may be necessary to add water to the pile to maintain the proper buoyancy.

After the pile is driven to the desired depth, which in the example given is 200 ft, one or more smaller diameter pipes 29, for example, two to three feet in diameter and pre-positioned within the much larger pile, may be driven further into the seabed to provide additional anchorage. The smaller pipes 29 are then rigidly connected to pile 10, for example, by being grouted to an inside sleeve of the pile.

This procedure is then repeated to build the desired number of piles. Continuing the example given above, three piles are built in accordance with the foregoing procedure, each pile being positioned 200 ft from its neighbors, thereby forming an equilateral triangle. Water is then pumped out of the piles above the permanent bulkhead, thereby putting the piles in tension below the bulkhead. The piles are all simultaneously pumped at an equal rate to ensure equal loading.

The network of large girders or trusses is then installed using conventional marine construction techniques. In our example, these are 220 ft long and 30 ft deep. Thereafter, the platform deck and facilities such as production modules, drilling modules, drilling rigs, quarters and helideck are added in a conventional manner.

The addition of submerged struts, if desired, is done after the piles have been driven, since it is not contemplated that all the piles are driven simultaneously. Therefore, this addition involves underwater construction techniques when the piles are anchored by being driven into the sea floor.

FIGS. 10–18 show additional embodiments of the present invention and various details thereof. Again, those features which are the same as in the previously described embodiments are given the same numbers.

Figure 10A:
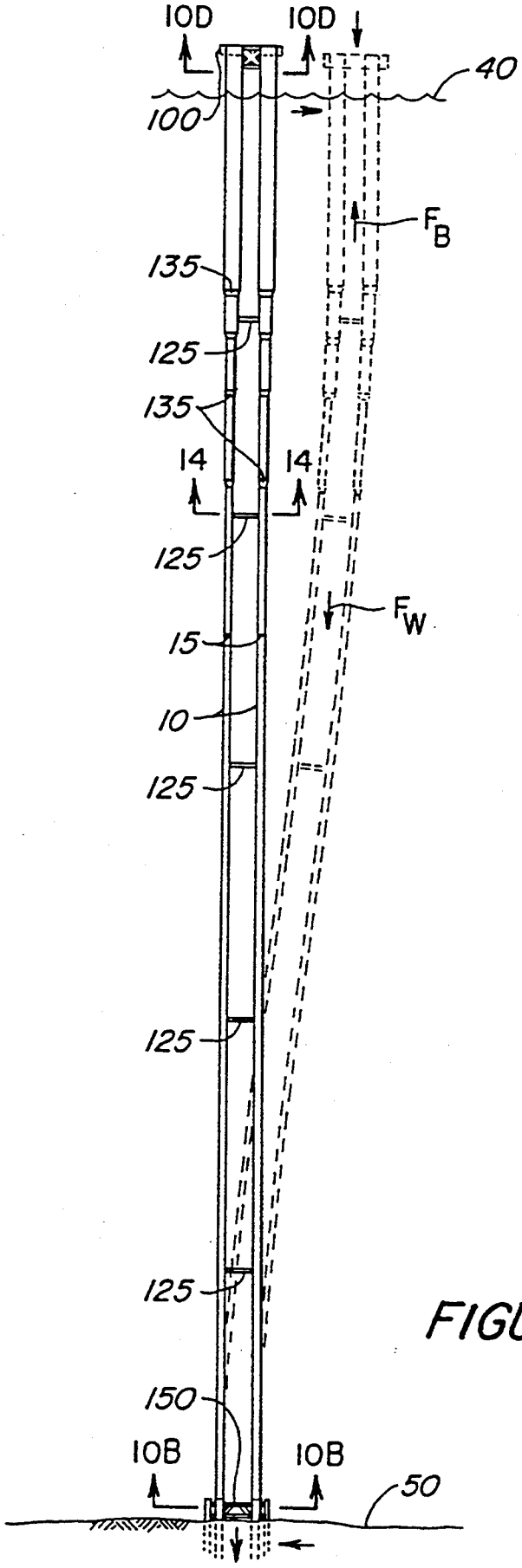
FIGS. 10A, 10B and 10D are elevations of an alternate embodiment of an offshore platform structure, and detailed portions thereof, in accordance with the present invention.

FIG. 10A is an elevational view of a structure having four buoyant piles 10 connected together by rigid bending member 110 near the upper ends of the piles, above the surface of the water 40. For clarity, only two piles are shown. In the FIG. 10A embodiment, bending member 110 is a short, very stiff truss at the level of platform 100. As described above, bending member 110 must be very stiff to prevent rotation of the tops of the buoyant piles so that platform 100 will remain relatively level under all environmental conditions.

Figure 11:
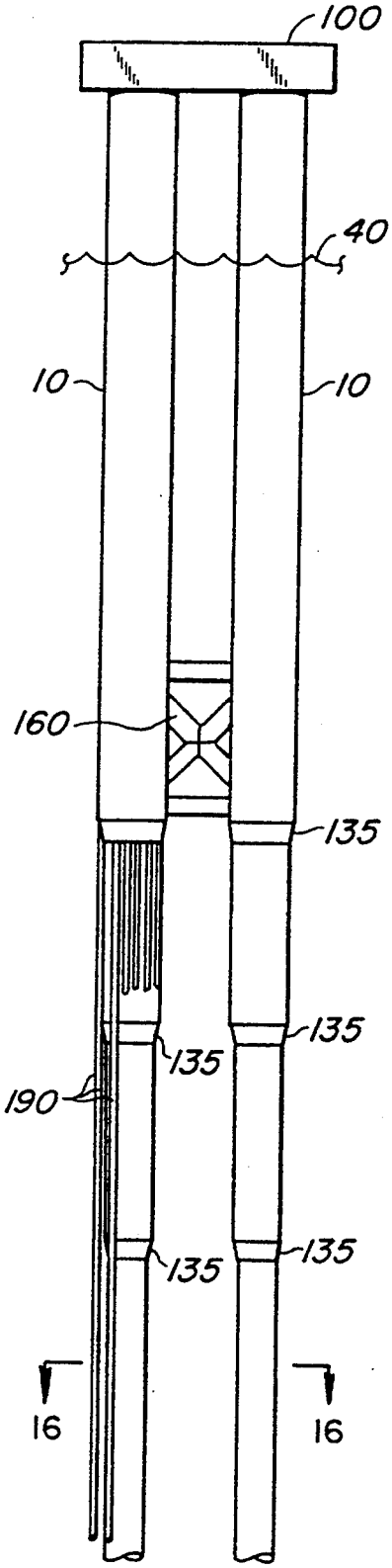
FIG. 11 is an elevational view of the upper portion of an offshore platform structure in accordance with yet another embodiment of the present invention.
Figure 12:
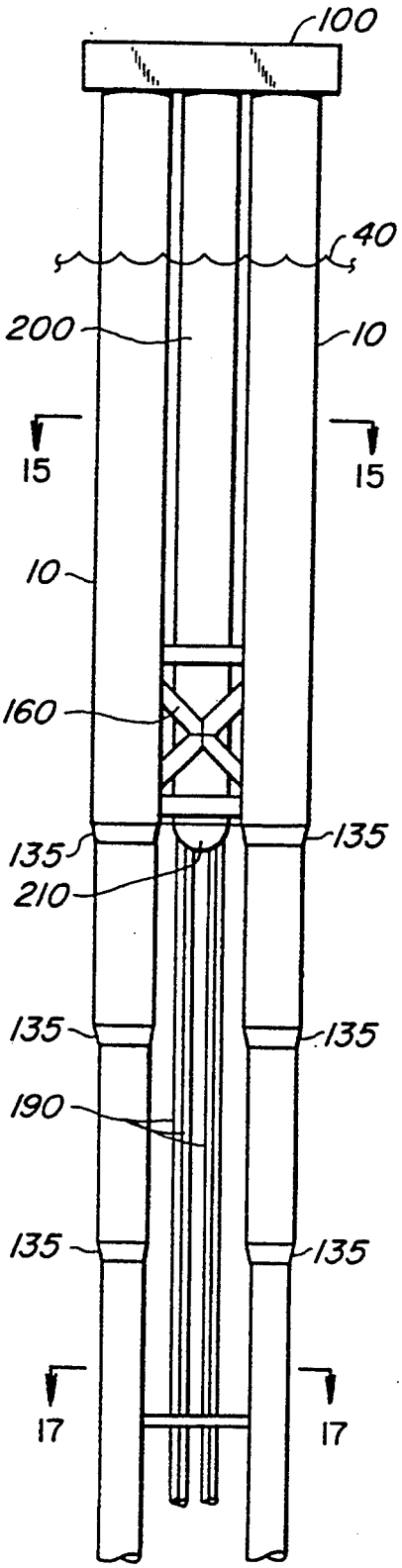
FIG. 12 is an elevational view of the upper portion of an offshore platform structure in accordance with still another embodiment of the present invention.
Figure 13:
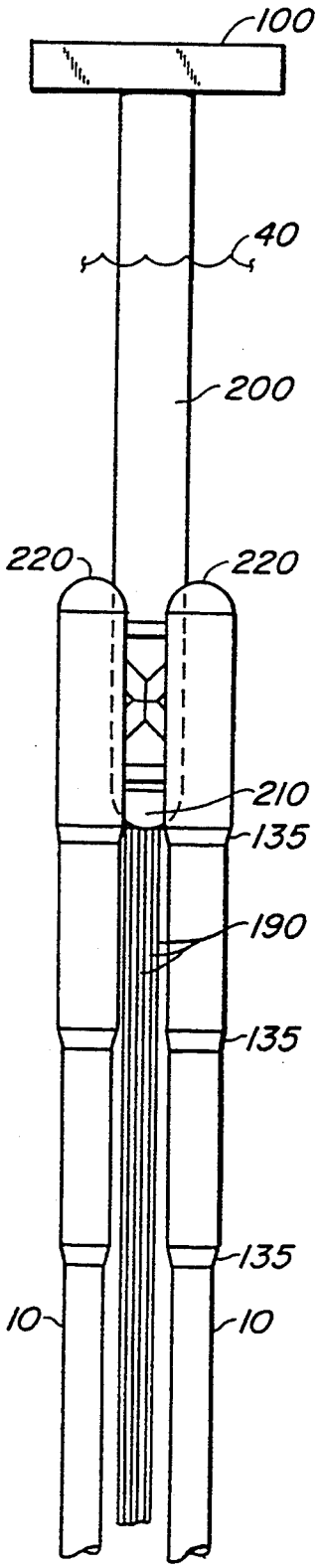
FIG. 13 is an elevational view of the upper portion of an offshore platform structure in accordance with yet another embodiment of the present invention.
Figure 15:
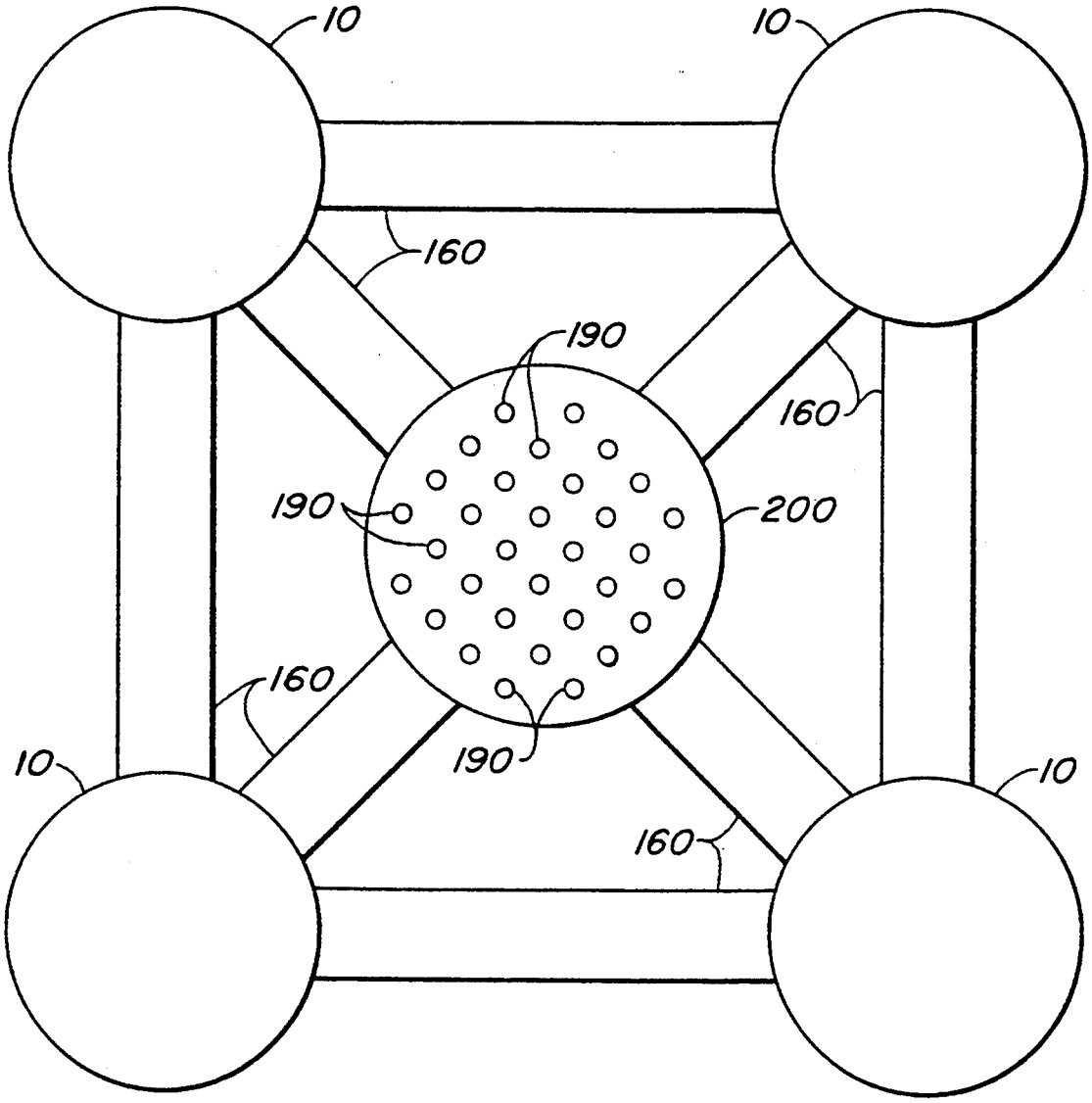
FIG. 15 is a view of the embodiment of FIG. 12 taken across view lines 15—15.

In the embodiment of FIG. 10A piles 10 have increasingly narrower diameters as they extend farther below the surface of the body of water 40. As is also shown in FIGS. 11, 12 and 13, there are several reductions in the diameter of the buoyant piles at conical transitions 135 so that the overall structure is telescoped. In one embodiment, conical transitions 135 are located at various depths below water surface 40. In this embodiment, the uppermost portion of the pile is thirty-five feet in diameter. The diameter reduces five feet at each transition, so that the lowermost portion of the pile is only fifteen feet in diameter.

The effects of hydrostatic pressure on a hollow, empty pile increase both with depth and with the exposed surface area. Reducing the pile diameter (and hence the surface area per unit length) with increasing depth will subject the pile wall to less hydrostatic stress as the depth of the empty, (i.e., buoyant) part of the pile becomes greater. As stated above, the water-filled portion of pile below bulkhead 15 is in communication with the surrounding body of water and, thus, is not subject to differential hydrostatic pressure. Accordingly, as shown, no further reductions in pile diameter are needed below the depth of bulkhead 15. It is contemplated that at certain offshore sites the bulkhead will be located at a sufficiently great depth that hydrostatic pressure on piles 10 above the bulkhead will be significant enough to warrant use of the telescoped design.

The telescoped design also increases the displacement of water near the surface, thus raising the center of buoyancy, which acts at the center of gravity of the displaced water. It should be noted, however, that the exposure of the structure to wind, wave and current forces is greatest near the water surface; thus, the larger the diameter of the buoyant pile near its upper end, the greater will be the exposure to these environmental forces.

FIGS. 10A, B and C also show an alternate approach to anchoring piles 10 of the present invention. In particular, rather than driving the piles into the sea floor, as previously described, the piles are anchored by a second rigid bending member comprising a truss 150 positioned on the bed 50 of the body of water and anchored thereto. As is described in greater detail below, second bending member 150 may be anchored using a plurality of skirt piles 155 driven into the bottom 50 of the body of water. While a truss is shown in FIGS. 10A, B and C, it will be appreciated by those skilled in the art that other stiff bending member designs can be substituted without departing from the present invention.

This alternate means of anchoring the piles of the present invention is useful when it is desired to prefabricate the structure at a shore facility and, thereafter, tow it to its desired location. For example, if the buoyant piles are too long and are very large in diameter, it may be impractical to drive individual piles into the bottom to achieve anchorage. Under such circumstances it would be more practical to construct the structure in segments in horizontal alignment on land. After one segment is built, it could be launched horizontally in shallow water with one end tied to the fabrication-yard bulkhead. The next segment would be welded to the segment previously launched, and in turn the assembly of segments would be launched in sequence (horizontally) until the entire structure is completed.

Figure 14:
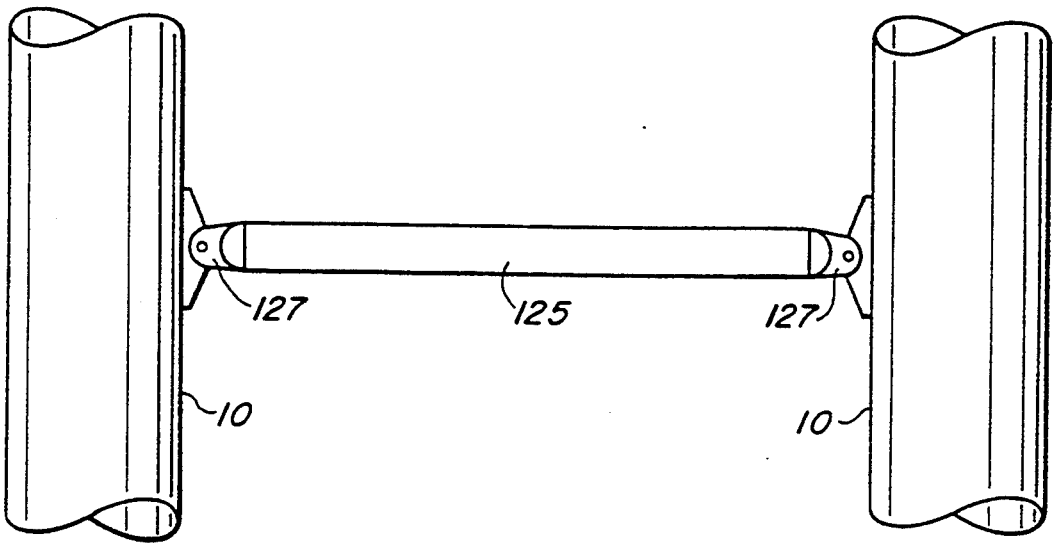
FIG. 14 is an elevational view of a pin-ended strut used in connection with the present invention.

If this method of construction is employed, it is preferred that there be multiple struts 125 connecting buoyant piles 10 to one another. Struts 125 would be required at the end of each segment for connecting the buoyant piles to each other. A typical strut 125 is shown in FIG. 14. Struts 125, in addition to rigid truss 150 at the bottom of the structure, keep the buoyant piles from moving longitudinally relative to one another. Struts 125 also keep piles 10 separated during the towing to the site, during upending, and when in the final installed position.

Struts 125 have the additional advantage of being able to resist eddy currents which are sometimes present at the sites of offshore structures. Eddy currents could exert forces in different directions on the buoyant piles, and the struts will prevent relative movement between the individual buoyant piles.

Figure 16:
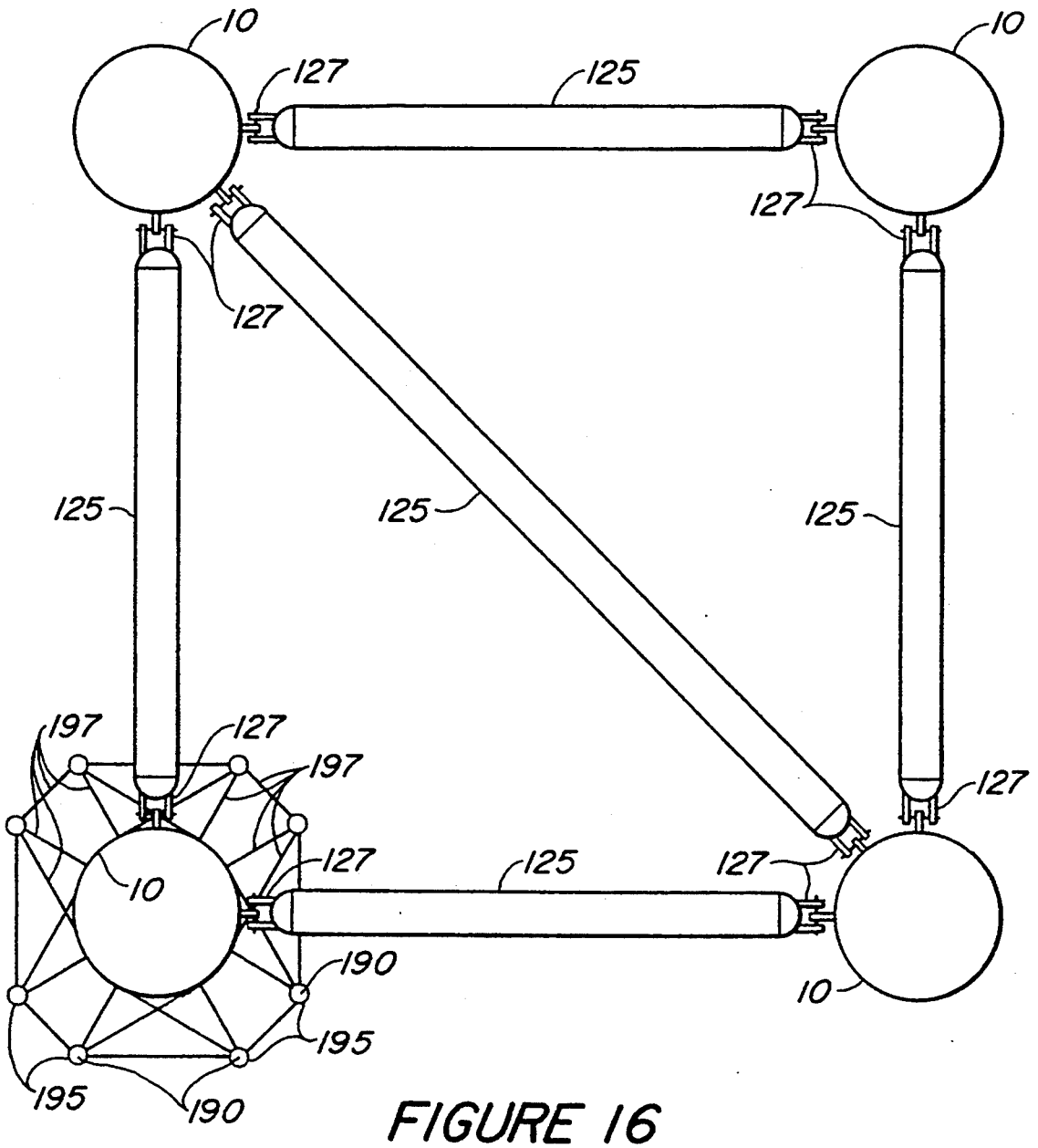
FIG. 16 is a view of the embodiment of FIG. 11 taken across view lines 16—16.

Preferably, struts 125 used in connection with the present invention are attached to the buoyant piles using single-pin connections 127 and, thus, will not restrain the buoyant piles from moving laterally when subjected to the horizontal force of wind, waves and current. A detail plan view of a plurality of struts is shown in FIG. 16. Since pin connectors 127 allow struts 125 to rotate, the only restraint against lateral movement of the structure comes from the stiff-bending members 150 and 110 at the sea floor and near the top ends of the piles, respectively. Use of pin-ended struts 125, thus, permits a larger lateral movement before bending stresses in the buoyant pile become too high, and the contribution of the buoyant force to righting moment will be greater. As described above, this righting moment due to buoyancy is proportional to the buoyant force and to the offset, also referred to as horizontal excursion or lateral movement, of the piles from over the anchorage. In an embodiment having four buoyant piles 10 arranged in a square, struts 125 may be used to connect adjacent piles along an edge of the square, and may also be used along a diagonal of the square to connect piles at opposite corners, as is shown in FIG. 16.

Figure 10B:
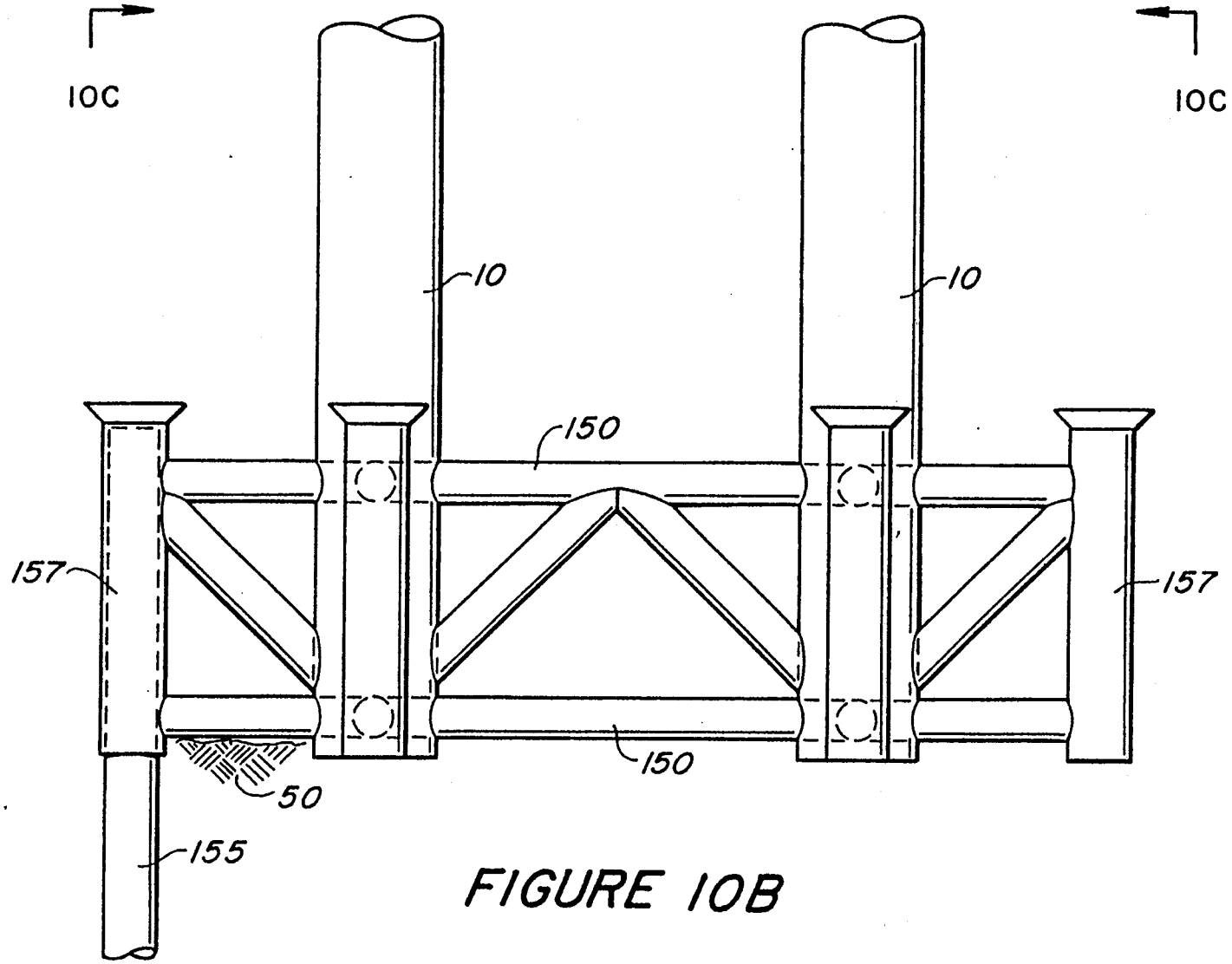
Figure 10C:
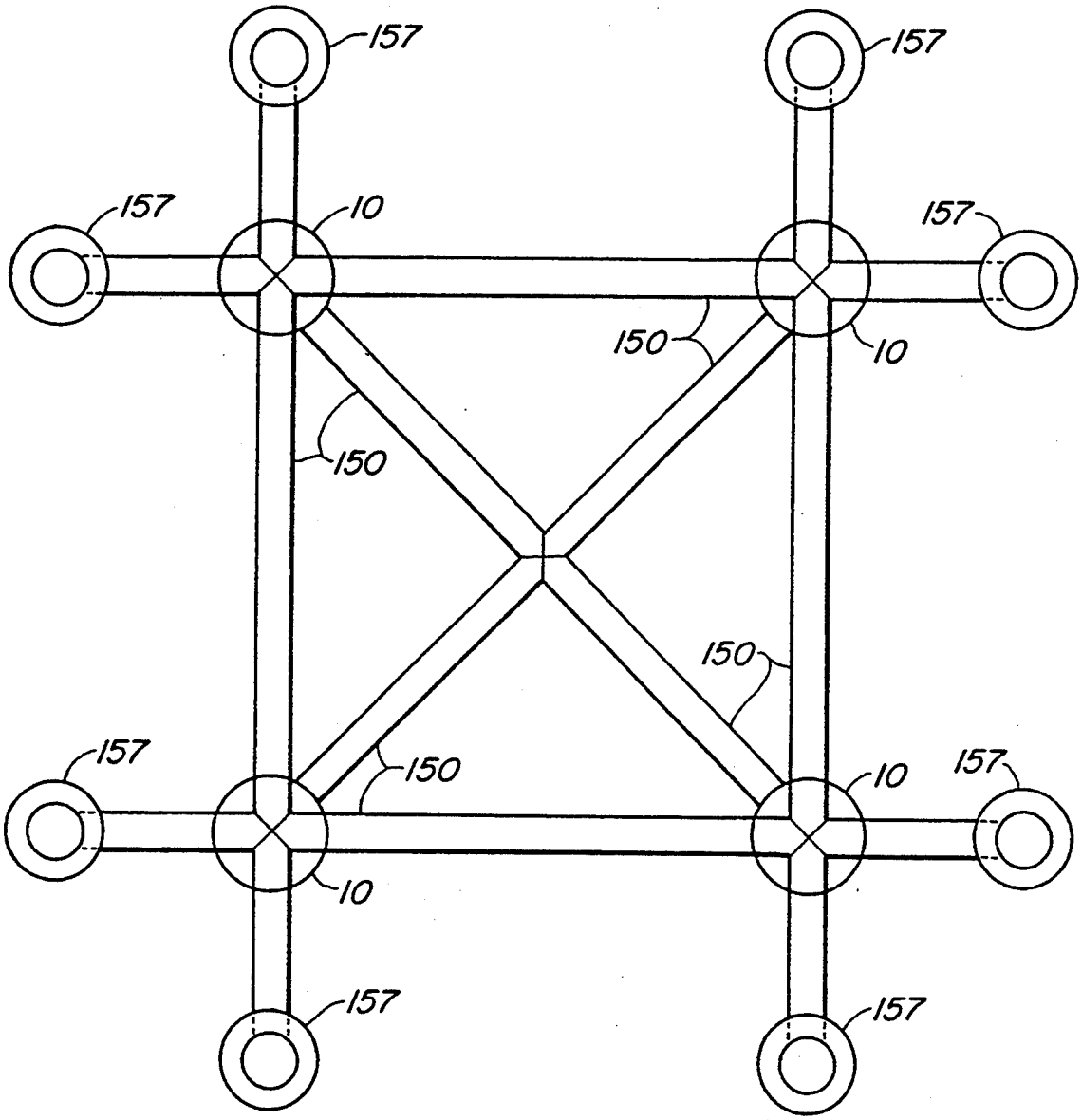
FIG. 10C is a plan view of the portion of the structure of FIG. 10B.
Figure 10D:
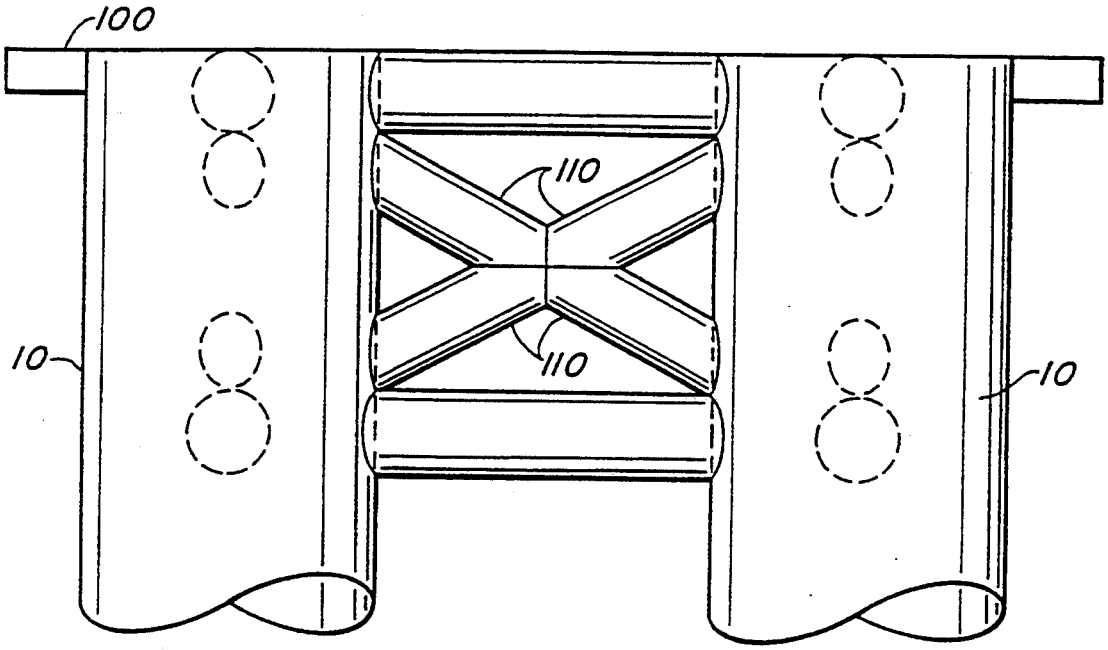

The anchorage shown in FIGS. 10A, B and C uses skirt piles 155 which, under many conditions, may be the best method of anchoring the structure to sea floor 50. Stiff bending member 150 at sea floor 50 include a plurality of skirt-pile sleeves 157 to the structure, through which skirt piles 155 are driven. Skirt piles 155 have a much smaller diameter than the buoyant piles. In one embodiment the diameter of the skirt piles is between seven and eight feet. While in FIG. 10C eight skirt-pile sleeves are shown, it will be apparent to those skilled in the art that a larger or smaller number of skirt piles may be used depending on the conditions at the site and the nature of the structure being anchored. Skirt piles are commonly used to anchor offshore structures, and methods for fabricating and driving them are well known to those familiar with the trade. Detailed plan and elevation views of bottom truss 150, skirt piles 155 and skirt pile sleeves 157 are shown in FIGS. 10B and C.

FIG. 11 shows a partial elevation of another embodiment of the present invention. In the FIG. 11 embodiment, the upper truss (or bending member) 160 is at a lower level, well below the water surface 40. An advantage of locating the truss below water surface 40, instead of at the platform level, is that bending member 160 does not interfere with other functions and activities that occur at the platform level. Preferably, in this embodiment, bending member 160 is located below the depth of any substantial horizontal-force exposure resulting from environmental conditions such as waves, current and wind. Wave and current forces are generally greatest near water surface 40 and decrease with depth. As a practical matter, at many sites it should be possible to locate bending member 160 at a level where these forces are no longer significant. Because the bending member is large, with a significant area subject to wind exposure, locating it below the water surface will significantly reduce the wind force on the structure.

Locating bending member 160 below water surface 40, as shown in FIG. 11, also increases the overall stiffness of the structure since the length of buoyant pile between rigid anchorage 150 and bending member 160 is shorter. This decrease in length decreases the portion of righting moment contributed by the buoyant force, because the offset of lateral movement of the top of the piles from above the anchorage is less. Thus, the portion of righting moment contributed by bending of the buoyant piles is proportionally increased.

The embodiment of FIG. 11 also shows the telescoping pile structure described above in reference to FIG. 10, and may, likewise, include the anchoring means 150 and the strut means 125 shown in connection with FIGS. 10, 14 and 16.

In the embodiments of FIGS. 10 and 11, conduits 190 used for communication between the platform 100 and positions along the structure and underneath the sea floor, i.e., conduits for drilling and for transporting oil and gas from the well to the platform, can be located within the large diameter of one or more of buoyant piles 10. If the diameter of the piles is reduced at various depths, as in the telescoped design shown in FIG. 10, conduits 190 can be designed to exit the buoyant piles at one of the conical transitions 135 as shown in FIG. 11. After exiting the interior of pile 10 at one of the conical transitions 135, conduits 190 can be attached to the exterior surface of the buoyant pile with sleeves 195 and brackets 197, as shown in FIG. 16.

Placing conduits 190 within buoyant piles 10 near water surface 40, where the wave and current forces are greatest, protects them from these forces and also reduces the total surface area and, hence, the net horizontal force on the structure. Preferably, the point along the pile(s) where the conduits exit should be below the depth where significant lateral forces are present.

FIG. 12 shows another embodiment of the present invention which incorporates a large-diameter, centrally located column 200 at the upper part of the structure. Column 200 is preferably equidistantly centered between the buoyant piles. In one embodiment, column 200 is forty feet in diameter, i.e., slightly larger than the diameter of the uppermost portion of the piles. This center column 200 is empty of water and, for maximum buoyancy, the interior may be open to the atmosphere in the same manner as piles 10 above their watertight bulkheads 15. Alternately, a portion of the volume of the column 200 may be used for product storage.

Column 200 increases the overall buoyancy of the structure and, therefore, will permit a greater payload (i.e., the total weight of the platform itself and any supported equipment, supplies, superstructure, etc.) on the platform 100. Additional buoyancy increases the righting moment when the structure is subjected to environmental forces. However, column 200 has the disadvantage of increasing the overall surface area of the structure that is exposed to environmental forces.

Figure 17:
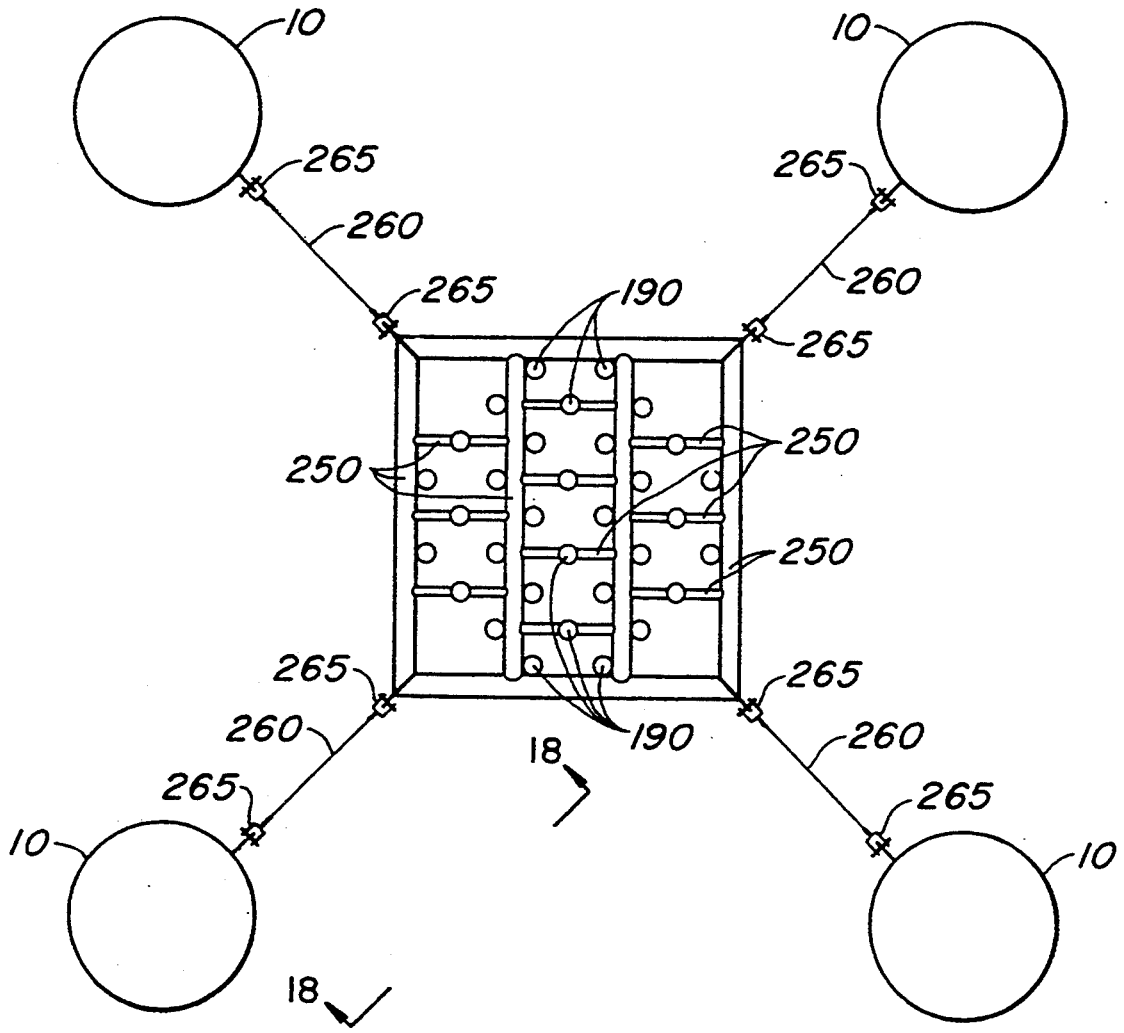
FIG. 17 is a view of the embodiment of FIG. 12 taken across view lines 17—17.
Figure 18:
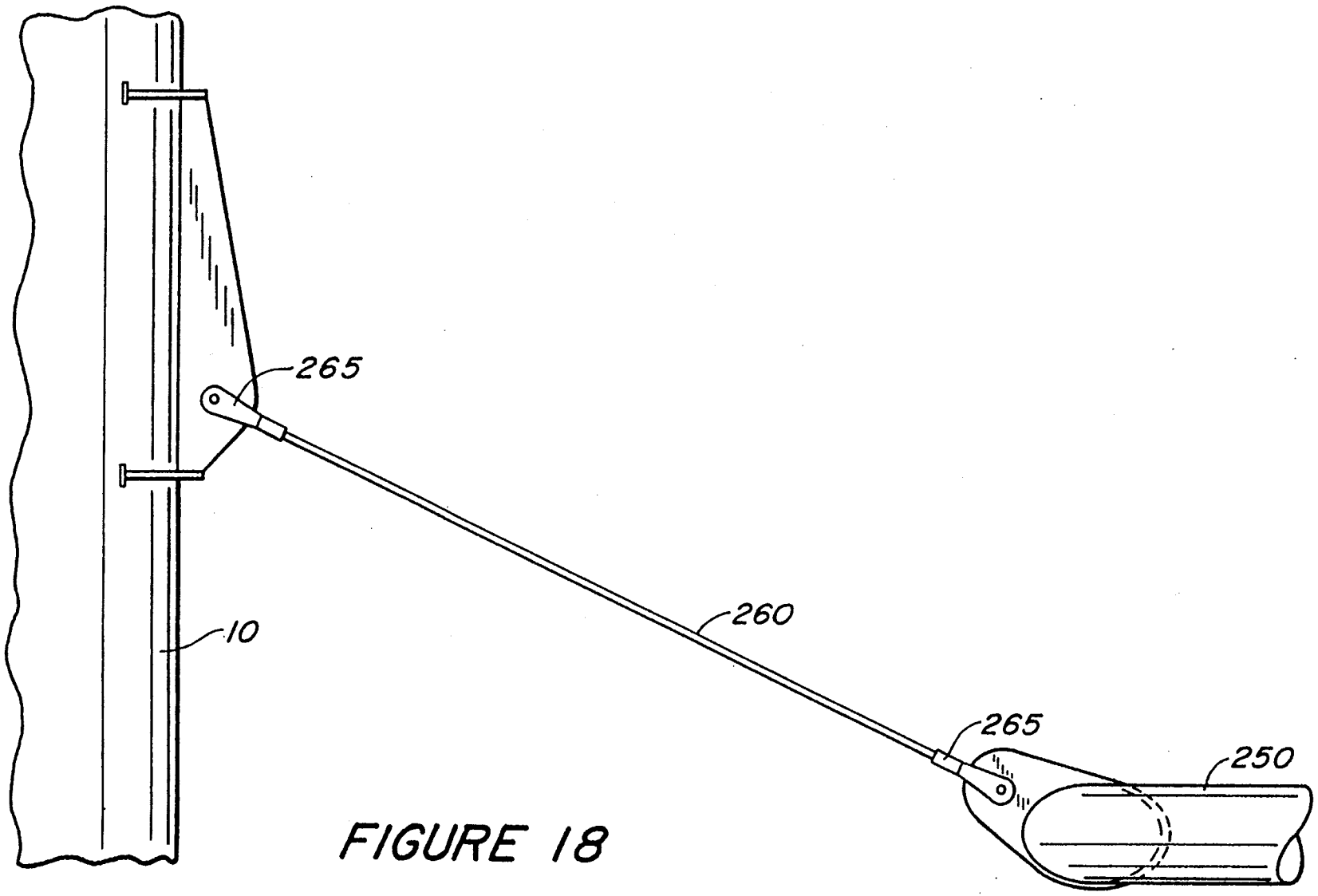
FIG. 18 is a view of the embodiment of FIG. 18 of a portion FIG. 17 taken across view lines 18—18.

One advantage of the use of a center column is that it permits conduits 190 to be located under the center of the platform 100, which is generally better and more conventional for offshore-drilling and production platforms. In a manner that is similar to that which has previously been described, the conduits can exit from the hemisphere-head base 210 of column 200 as shown in FIG. 12, at a depth at which the conduits will be subjected to much less lateral force. Below the level of column 200 conduits 190 can be braced by conduit-guide frames 250. A preferred design for a guide frame 250 is shown in FIG. 17. As shown in FIGS. 17 and 18, in the preferred embodiment, guide frames 250 are hung by flexible cables 260. Cables 260 are attached to the piles and the guide frame by pin connectors 265. This arrangement permits movement and articulation of the structure without causing excessive bending of conduits 190.

The embodiment of FIG. 12 may also incorporate many of the features of the FIG. 10 embodiment previously described. These include: (1) multiple reductions of diameter (i.e., telescoping) as the depth increases, (2) multiple pin-ended struts 125 connecting buoyant piles 10 to one another, and (3) a rigid truss 150 connecting the buoyant piles to one another and to the skirt piles 155 at the sea floor 50.

FIG. 13 shows yet another embodiment incorporating a single central column 200 connected to buoyant piles 10 by truss-bending members 160. In this embodiment, the single column 200 supports the platform 100 and payload by itself. The buoyant piles 10 terminate with hemispheric heads 220 at a depth well below water surface 40, preferably below the level of significant environmental forces. Since only the center column is located in the area of greatest wave and current forces, the FIG. 13 design has significantly less exposure to these forces. On the other hand, the FIG. 13 design also displaces less water than the designs previously described and, therefore, the payload capacity is less, and the portion of righting moment contributed by the smaller buoyant force is less.

Again, in the design of FIG. 13 conduits 190 for communicating with the sea bed are located within column 200 in the conventional position under the center of the platform, and exit column 200 at hemispheric head 210. In the same manner as the design of FIG. 12, the conduits 190 are, thus, protected near the water surface where the wave and current forces are greatest. The FIG. 13 design may also incorporate several features of the designs of FIGS. 10–12, including multiple reductions of the diameter of the buoyant piles, multiple pin-ended struts 125, and a rigid truss 150 at the sea floor 50 connecting the buoyant piles to one another and to the skirt piles 155.

A summary of the advantages and disadvantages of the designs of FIGS. 10–13 are as follows:

| | |
|---|---|
| FIG. 10: | |
| Advantages: | 1. Large payload.<br>2. Smaller exposure to lateral forces.<br>3. High righting moment. |
| Disadvantages: | 1. Unconventional location of conduits.<br>2. Large trusses at the platform level may interfere with other platform functions. |
| FIG. 11: | |
| Advantages: | 1. Large payload.<br>2. Smaller exposure to lateral forces.<br>3. High righting moment (resistance to overturning by environmental forces). |
| Disadvantages: | 1. Unconventional location of conduits. |
| FIG. 12: | |
| Advantages: | 1. Very large payload.<br>2. Very high righting moment.<br>3. Permits conventional location of conduits. |
| Disadvantages: | 1. Higher exposure to lateral forces.<br>2. High structural weight. |
| FIG. 13: | |
| Advantages: | 1. Very low exposure to lateral forces.<br>2. Low structural weight.<br>3. Permits conventional location of conduits. |
| Disadvantages: | 1. Low payload.<br>2. Low righting moment (resistance to overturning moment). |

It will be seen from the above that each of the embodiments of FIGS. 10–13 have relative advantages and disadvantages. Selection of the optimal design for a particular application will depend on the unique conditions at the offshore site where the structure is to be installed, the nature of the payload to be used at the site, and the nature of the operations that will be conducted at the site. Generally, the conditions that are to be considered in selecting the optimal design for a given location can be quantified and the best-suited design can be objectively determined. The important factors include the depth at the site, the total weight of the payload, the nature of the sea floor at the site, the strength of an anchorage at the site, and the worst case environmental conditions likely to be encountered at the site.

Figure 3:
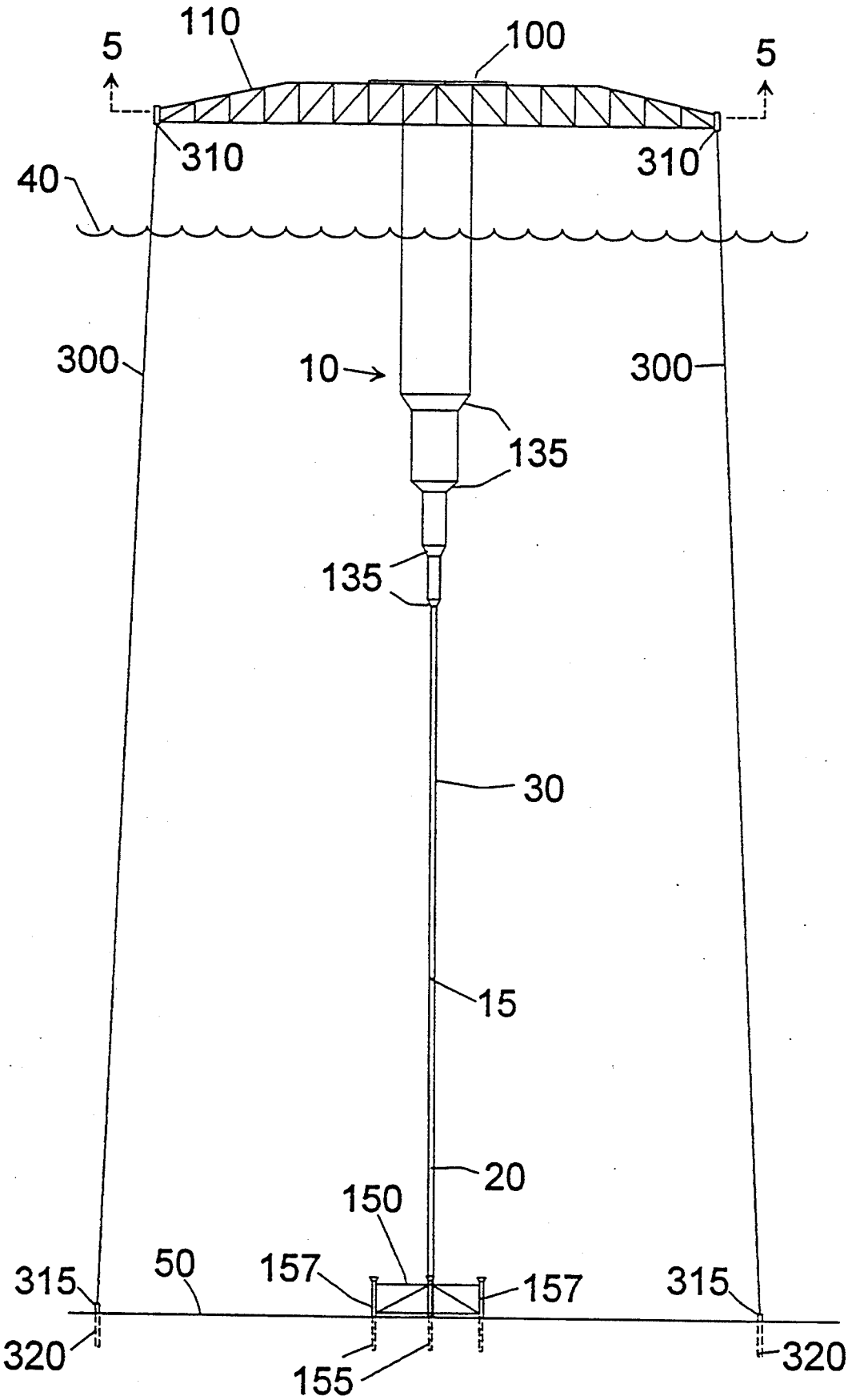
FIG. 3 is an elevation of another embodiment of an oil platform, constructed in accordance with the present invention employing tendons to stabilize the platform.
Figure 4:
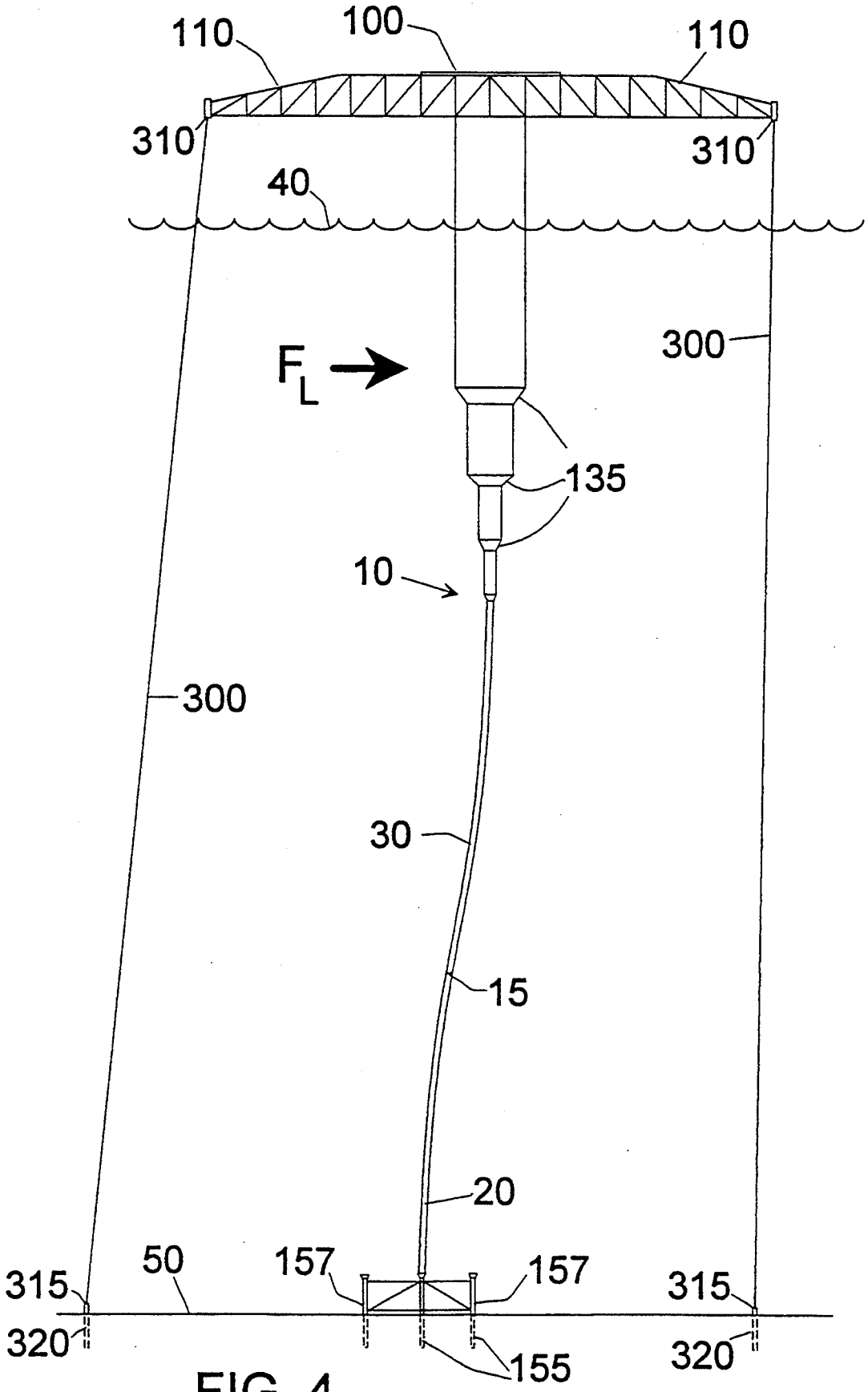
FIG. 4 is an elevation of the oil platform of FIG. 3 being displaced due to a lateral force thereon.
Figure 5:
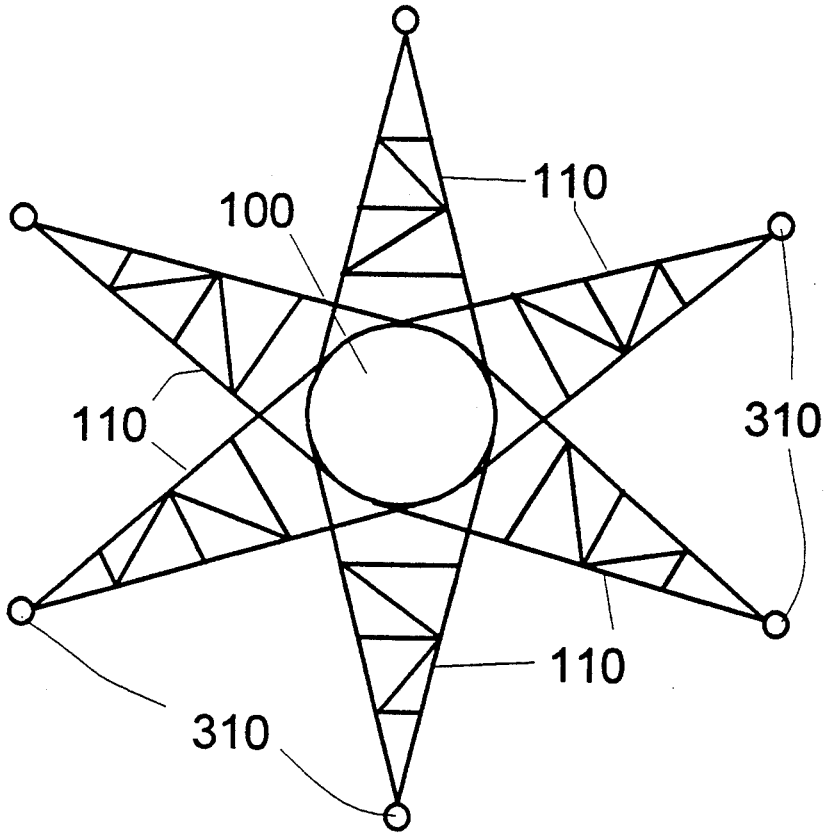
FIG. 5 is a plan view of the truss structure of the embodiment of FIG. 3 along view lines 5—5.

An additional embodiment of an offshore platform utilizing a single buoyant pile of the present invention is shown in FIGS. 3–5. In this embodiment, there is a single buoyant flexible pile 10 supporting a platform 100, and stabilized by a plurality of tendons 300 as described below. The diameter of pile 10 varies at conical transitions 135 with the diameter being largest near the surface where the hydrostatic stresses are low. Bulkhead 15 is located at sufficient depth to provide the required buoyant forces. As described above, buoyant pile 10 could either be driven into seabed 50 for anchorage or, as shown in FIG. 3, anchored with skirt piles 155, which are grouted to sleeves 157 that are connected to buoyant pile 10 by bottom truss 150.

The top of buoyant pile 10 is rigidly connected to a plurality of bending members 110. In the preferred embodiment, bending members 110 are trusses as shown in FIGS. 3–5. Bending members 110 support platform 100 which in turn supports all of the drilling and production equipment, quarters, etc. One end of each bending member 110 is rigidly connected to the top of buoyant pile 10. The number of bending members 110 that rigidly connect to the top of buoyant pile 10 is three or more, although for clarity only two are shown in FIGS. 3 and 4. Preferably, bending members radiate from the centerline of buoyant pile 10, as shown in FIG. 5 which is a plan view of bending members 110 (trusses) and platform 100 showing a configuration of six bending members 110.

The other ends of bending members 110 (trusses) are connected to tendons 300. The tendons 300 could be cables, pipes, or other structural shapes capable of transmitting a large tension force. The tendons 300 are attached to the top of bending members 110 with connections 310 that may be flexible joints or universal joints. Alternately, tendons 300 may be rigidly connected to bending members 110. The other ends of the tendons 300 are anchored at seabed 50 with connections 315 to anchor piles 320. Negative-pressure anchor devices could be used instead of anchor piles 320. Connection 315 may also be flexible joints, universal joints or rigid joints.

Tendons 300 prevent the top bending members 110 from rotating out of horizontal alignment when pile 10 and the structures mounted thereon are subjected to a large lateral force $F_L$, as shown in FIG. 4, due to the net combined effect of environmental forces such as wind, waves and current. If the top bending members 110 cannot rotate from horizontal alignment, then the top of buoyant pile 10, which is rigidly connected to the top bending members 110, cannot rotate from vertical alignment. Therefore, a bending moment will be induced in buoyant pile 10 at the top, similar to the bending moment induced into the top of two or more buoyant piles 10 that are connected at their tops by bending members 110 as previously described.

Thus, when buoyant pile 10 is subjected to the environmental forces of wind, waves and current ($F_L$), it will move laterally as shown in FIG. 4. Because tendons 300 prevent bending members 110 from rotating, a bending moment will be induced in buoyant pile 10. This bending moment will help stabilize buoyant pile 10 and will prevent platform 100 from departing substantially from horizontal alignment. When the environmental forces of wind, waves and current cause the top of buoyant pile 10 to take a large offset from vertical alignment, the tops of tendons 300 will also move laterally. Therefore, tendons 300 will transmit a larger horizontal component of force to the top of buoyant pile 10 and to its anchorage. This horizontal component of force helps resist the environmental forces of wind, waves and current.

Tendons 300 can be vertical or can slope slightly from vertical as shown in FIG. 3. Tendons 300 are preferably neutrally buoyant pipe; therefore they will not impart a downward force to bending members 110 beyond the downward force necessary to prevent bending members 110 from rotating upward at connections 310 to tendons 300.

Figure 7:
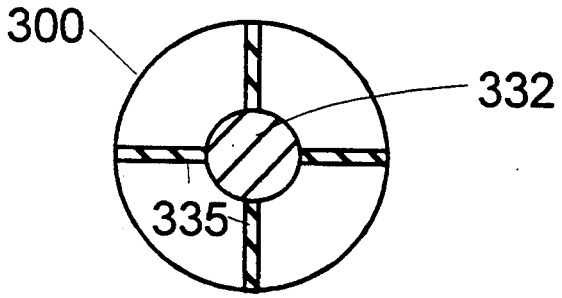
FIG. 7 is a somewhat schematic cross-sectional view of the lower end of a tendon along view lines 7—7.
Figure 6:
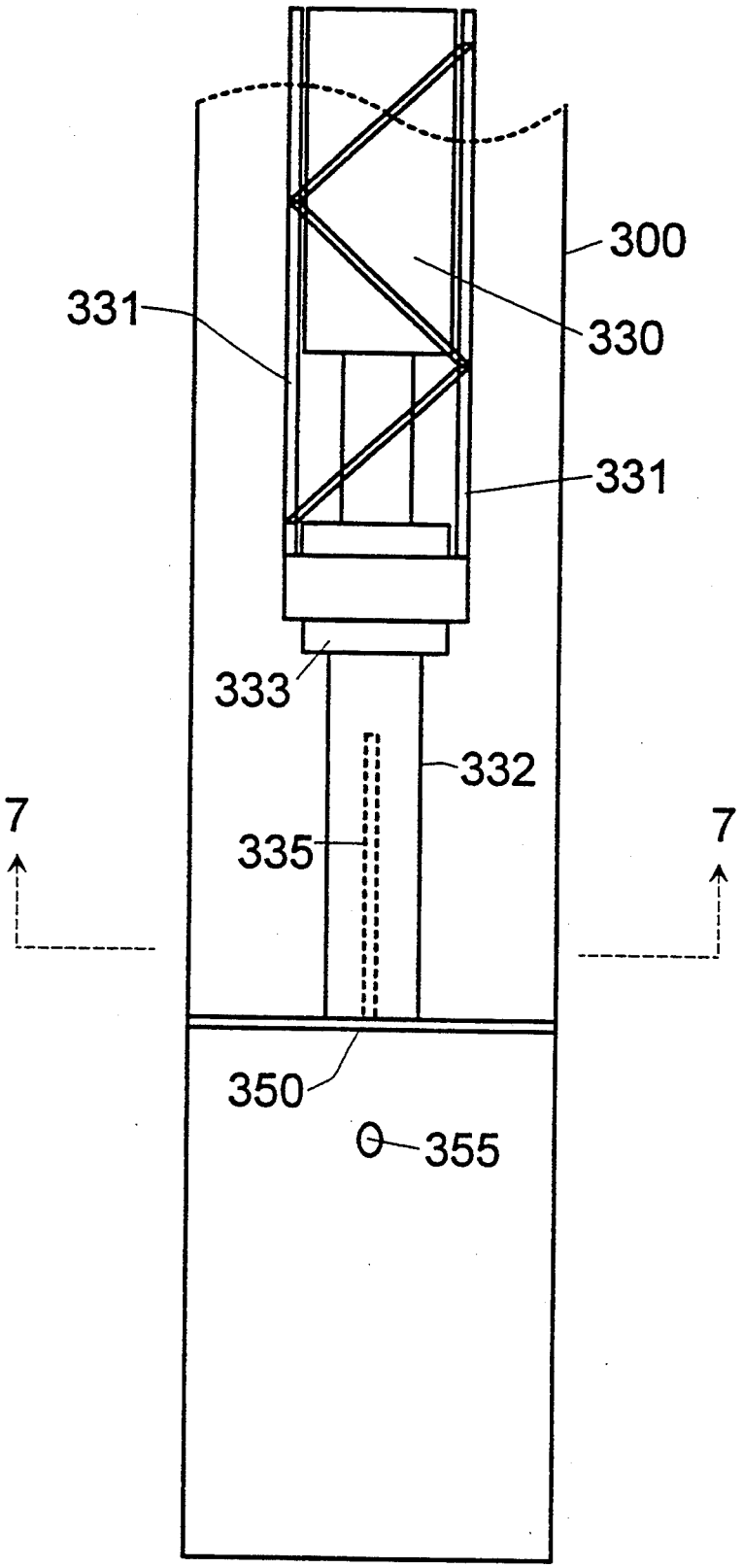
FIG. 6 is a somewhat schematic cross-sectional view of a pile driver mounted within the lower end of a tendon or pile of the present invention.

In accordance with the present invention, as shown in FIG. 6, tendons 300 can be driven into seabed 50 by pile driver 330 which is adapted to be positioned within the interior and very near the bottom of tendons 300. When using this method, the interior of tendons 300 are open to the atmosphere and pile driver 330 and leads 331, which guide pile driver 330, can be inserted from the top of the tendon above the water surface. Alternately, leads 331 could be omitted and the interior walls of tendon 300 could guide pile driver 330. Pile driver piston head 333 rests upon mandrel 332 that is part of the base of the closed end or tip of tendon 300. As shown in FIGS. 6 and 7, mandrel 332 is attached to the interior of tendon 300 by gussets 335 and bulkhead 350. Bulkhead 350 separates the tip of the tendon, which is driven into the sea bed, from the portion of the tendon which is open to the atmosphere and which houses pile driver 330. A plurality of pressure relief holes 355 (only one shown) allows fluid in the tendon tip below bulkhead 350 to escape as the tendon is driven into the sea floor. Because tendon 300 is driven into seabed 50 in this embodiment, it would perhaps be more descriptive to call the portion driven below seabed 10, and possibly the entire tendon 300, a tendon pile.

In a similar fashion large buoyant piles 10 could also be driven into seabed 50, using pile drivers 330 located within the large diameter of the base of buoyant pile 10.

The primary advantages of pile driver 330, located within the interior of the pile is that it can operate in air and not underwater, and it delivers the pile-driving energy to the pile near the tip where it will be most effective for penetrating seabed 50.

Those skilled in the art will recognize that numerous other modifications and departures may be made with the above-described apparatus without departing from the scope and spirit thereof. It is therefore intended that the scope of the present invention be limited only by the following claims.

What is claimed is:

1. A deep water support system for supporting a structure adjacent to the surface of a body of water at a preselected site, comprising;

a buoyant pile having a lower end rigidly anchored to the bottom of said body of water, said pile being of a length greater than the depth of said body of water at said site, bending member means coupled to the upper end of said pile for securing said structure and for resisting any departure from the vertical of the portion of said upper end of said pile above the surface of said body of water, a plurality of tendons coupled at their upper ends to said bending member means and anchored at their lower ends to the floor of the body of water said pile comprising an elongate tubular structure having an interior watertight bulkhead means positioned at a predetermined location within said pile interior, said location selected so that said pile has a predetermined buoyancy when the portion of said pile below said bulkhead is open to the water and the portion of said pile above said bulkhead is filled with air, said predetermined buoyancy being such that the portion of said pile below said bulkhead is in substantial tension.

2. The deep water support system of claim 1 wherein said tendons are substantially neutrally buoyant.

3. The deep water support system of claim 2 wherein said tendons are hollow pipes.

4. The deep water support system of claim 3 wherein said pipes are filled with air over substantially their entire length.

5. The deep water support system of claim 3 further comprising pile driver means positioned within the lower end of said hollow pile.

6. The deep water support system of claim 1 wherein the diameter of said pile is different near said bottom than it is near said surface.

7. A deep water support system for supporting a superstructure at a preselected site located in a body of water, comprising:

a buoyant pile having a lower end rigidly anchored to the bottom of the body of water, said pile comprising an elongate tubular structure at least partially filled with buoyant material, said tubular structure having a telescoped shape such that the portion of the pile closest to the surface of the body of water has the largest diameter, and the portion of the pile closest to the bottom of the body of water has the smallest diameter, whereby the buoyancy of the upper portion of the pile is increased, bending member means coupled to the upper end of said pile, said bending member means having a portion thereof distal from the pile and tendon means coupled at its upper end to the portion of said bending member means distal from said pile and anchored at its lower end to the floor of the body of water.

8. The deep water support system of claim 7 wherein said tubular structure comprises at least three portions having different diameters.

9. A deep water support system for supporting a superstructure at a preselected site located in a body of water, comprising:

a buoyant pile having a lower end rigidly anchored to the bottom of the body of water, said pile comprising an elongate tubular structure at least partially filled with buoyant material, said tubular structure having a telescoped shape such that the portion of the pile closest to the surface of the body of water has the largest diameter, and the portion of the pile closest to the bottom of the body of water has the smallest diameter, whereby the buoyancy of the upper portion of the pile is increased, bending member means coupled to the upper end of said pile, and tendon means coupled at its upper end to said bending member means and anchored at its lower end to the floor of the body of water, wherein said tendon means has an interior portion near the lower end thereof which is adapted to receive pile driving means for driving said tendon means into the floor of the body of water.

* * * * *